US006862428B2

(12) United States Patent
Sasaki

(10) Patent No.: US 6,862,428 B2
(45) Date of Patent: Mar. 1, 2005

(54) PRINTER WITH SHEET REVERSAL MECHANISM

(75) Inventor: Toshiyuki Sasaki, Nagano (JP)

(73) Assignee: Seiko Epson Corporaton, Tokyo (JP)

( * ) Notice: Subject to any disclaimer, the term of this patent is extended or adjusted under 35 U.S.C. 154(b) by 0 days.

(21) Appl. No.: 10/343,800

(22) PCT Filed: Jun. 4, 2002

(86) PCT No.: PCT/JP02/05521

§ 371 (c)(1),
(2), (4) Date: Jul. 8, 2003

(87) PCT Pub. No.: WO02/100648

PCT Pub. Date: Dec. 19, 2002

(65) Prior Publication Data

US 2004/0028447 A1 Feb. 12, 2004

(30) Foreign Application Priority Data

Jun. 4, 2001 (JP) ..... 2001-168658
Oct. 10, 2001 (JP) ..... 2001-312942
Oct. 29, 2001 (JP) ..... 2001-331111

(51) Int. Cl.[7] ..... B41J 11/58

(52) U.S. Cl. ..... 399/401; 355/24; 271/186; 400/636; 400/642

(58) Field of Search ..... 400/188, 636, 400/283, 642; 101/230; 271/186; 399/401; 355/24

(56) References Cited

U.S. PATENT DOCUMENTS 4,591,884 A 5/1986 Miyamoto et al.

5,764,263 A * 6/1998 Lin ..... 347/101

(List continued on next page.)

FOREIGN PATENT DOCUMENTS

JP 59-31178 1/1984
JP 59-160158 9/1984

(List continued on next page.)

*Primary Examiner*—Andrew H. Hirshfeld
*Assistant Examiner*—Dave A. Ghatt
(74) *Attorney, Agent, or Firm*—Nixon & Vanderhye P.C.

(57) ABSTRACT

In a printer provided with a sheet reversing mechanism, and which can perform printing on both faces of a sheet by a common print head, reduction of the number of parts, prevention of a transport failure, and the like are realized by reversing the sheet while the sheet is clamped by one transporting roller pair. The printer includes a first sheet path. A print head is disposed on the first sheet path to perform printing on a recording sheet. A transporting roller pair includes a first roller and a second roller, adapted to transport the recording sheet in a first direction approaching the print head (toward an outlet) and a second direction opposed to the first direction (toward an inlet). A second sheet path is branched from the first sheet path at a branching position shifted from the first roller in the second direction, extending along an outer periphery of the first roller, and joined to the first sheet path at a joining position between the transporting roller pair and the print head. A path switcher is disposed in the vicinity of the branching position so as to be placed at a first position for selecting the first sheet path and a second position for selecting the second sheet path, so that a path of the recording sheet transported in the second direction is switched to the first sheet path or the second sheet path.

18 Claims, 28 Drawing Sheets

U.S. PATENT DOCUMENTS

| | | | | | |
|---|---|---|---|---|---|
| 5,772,343 | A | * | 6/1998 | Beretta et al. | 400/624 |
| 5,836,706 | A | * | 11/1998 | Ruhe | 400/636 |
| 5,865,547 | A | | 2/1999 | Harris et al. | |
| 5,887,868 | A | * | 3/1999 | Lambert et al. | 271/186 |
| 5,997,129 | A | * | 12/1999 | Matsuhashi | 347/35 |
| 6,000,867 | A | * | 12/1999 | Yoshii et al. | 400/188 |
| 6,017,161 | A | | 1/2000 | Harris et al. | |
| 6,109,521 | A | | 8/2000 | Martinez et al. | |
| 6,149,324 | A | * | 11/2000 | Song | 400/188 |
| 6,257,783 | B1 | * | 7/2001 | Hanaoka et al. | 400/578 |
| 6,286,831 | B1 | * | 9/2001 | Marasco et al. | 271/303 |
| 6,290,410 | B1 | * | 9/2001 | Sunada et al. | 400/624 |
| 6,393,251 | B2 | * | 5/2002 | Kono | 399/370 |
| 6,493,060 | B2 | * | 12/2002 | Gaarder et al. | 355/24 |

FOREIGN PATENT DOCUMENTS

| | | |
|---|---|---|
| JP | 60-212368 | 10/1985 |
| JP | 61-89876 | 5/1986 |
| JP | 61-149380 | 7/1986 |
| JP | 61-149383 | 7/1986 |
| JP | 61-154865 | 7/1986 |
| JP | 61-211067 | 9/1986 |
| JP | 61-222769 | 10/1986 |
| JP | 62-105827 | 5/1987 |
| JP | 62-134282 | 6/1987 |
| JP | 63-051168 | 3/1988 |
| JP | 3-53955 | 3/1991 |
| JP | 6-270482 | 9/1994 |
| JP | 8-230258 | 9/1996 |
| JP | 10-260559 | 9/1998 |
| JP | 11-11771 | 1/1999 |
| JP | 2001-22878 | 1/2001 |

* cited by examiner

PRINTER WITH SHEET REVERSAL MECHANISM

TECHNICAL FIELD

The present invention relates to a printer which has a sheet reversing mechanism, and which can perform printing on both faces of a sheet by a common print head.

BACKGROUND ART

Recently, a printer which can perform printing on both faces of a sheet has been developed. Printers of this kind include: a printer in which print heads respectively for front/back faces are separately disposed, as disclosed in Japanese Patent Publication No. 3-53955A; and that which comprises a mechanism for reversing a whole sheet to enable a single print head to perform double-sided printing, as disclosed in Japanese Patent Publications Nos. 59-31178A and 61-89876A.

In a printer of the type in which print heads respectively for front/back faces are separately disposed, however, a space for disposing the two print heads is necessary, and therefore down-sizing of the printer is obstructed. Moreover, there is a disadvantage that the number of parts is increased and the cost is high.

In a printer of the type which comprises a mechanism for reversing a whole sheet, the reversing mechanism is a complicated mechanism which reverses a sheet while transferring the sheet among plural roller pairs, thereby causing a disadvantage that the jam (sheet jamming) rate is high. A sheet reversing path which is sufficient for reversing a whole sheet must be ensured, and therefore down-sizing of the printer is obstructed. Moreover, there is a disadvantage that the time required for reversing a sheet cannot be neglected and causes a disadvantage that the throughput of the printer is lowered. Furthermore, there is another disadvantage that a sheet which is longer than the sheet reversing path cannot be reversed.

It is an object of the invention to provide a printer which comprises a sheet reversing mechanism, which can perform printing on both faces of a sheet by a common print head, and in which reduction of the number of parts, prevention of a transport failure, and the like are realized by reversing the sheet while the sheet is clamped by one transporting roller pair.

DISCLOSURE OF THE INVENTION

In order to attain the above object, according to the invention, there is provided a printer, comprising:

a first sheet path;

a print head, disposed with respect to the first sheet path to perform printing on a recording sheet;

a transporting roller pair including a first roller and a second roller, adapted to transport the recording sheet in a first direction approaching the print head (toward an outlet) and a second direction opposed to the first direction (toward an inlet);

a second sheet path, branched from the first sheet path at a branching position shifted from the first roller in the second direction, extending along an outer periphery of the first roller, and joined to the first sheet path at a joining position shifted from the first roller in the first direction; and a path switcher, disposed in the vicinity of the branching position so as to be placed at a first position for selecting the first sheet path and a second position for selecting the second sheet path, so that a path of the recording sheet transported in the second direction is switched to the first sheet path or the second sheet path.

According to the configuration, a recording sheet can be reversed in a J-like shape while the sheet is clamped by the transporting roller pair, and hence double-sided printing which is performed on the printing sheet by a common print head is enabled. As compared with the configuration in which a recording sheet is reversed while being transferred among plural rollers, the occurrence of sheet jamming can be suppressed. Moreover, the length of the second sheet path serving as a reversing path can be reduced, so that the printer can be downsized and the processing time can be shortened.

Preferably, the printer further comprises:

an urging member, which urges the path switcher toward one of the first position and the second position; and a retainer, which retains the path switcher at the other one of the first position and the second position.

Particularly in a configuration in which the path switcher is urged to the first position where the path switcher selects the first sheet path, and retained in the second position where the path switcher selects the second sheet path, the path switcher is not pivoted by the stiffness of the recording sheet when the recording sheet is reversed. Therefore, the length of the second sheet path can be maintained constant, and hence a back-face printing position setting/back-face printing process can be accurately performed.

Moreover, the printer may further comprise an actuator, which places the path switcher to the other one of the first position and the second position.

In addition, the printer may also comprise:

a carriage, on which the print head is mounted, adapted to reciprocally move in directions substantially perpendicular to the first direction and the second direction; and a switching cam, which places the path switcher to the other one of the first position and the second position, in accordance with a movement of the carriage to a predetermined position.

Alternatively, the printer further comprises:

a carriage, on which the print head is mounted, adapted to reciprocally move in directions substantially perpendicular to the first direction and the second direction; and a switching cam, selectively placed one of a plurality of cam positions while following a movement of the carriage toward non-printing areas, so as to place the path switcher to the first position when the carriage is placed at a first switching position arranged in one of the non-printing areas, and so as to place the path switcher to the second position when the carnage is placed at a second switching position arranged in the other one of the non-printing areas.

In this case, the switching cam includes a cam piece adapted to be abutted against an engaging portion of the path switcher to displace the path switcher. According to the configuration, the path switcher is enabled to conduct a switching operation, simply by controlling the position of the carriage.

Moreover, the printer further comprises a switching controller, which places the path switcher to one of the first position and the second position when a trailing end of the recording sheet transported along the first sheet path in the first direction situates a position shifted from the branching position in the first direction, and drives the transporting roller pair to transport the recording sheet in the second direction.

Preferably, the printer further comprises a guide member, which forms at least a part of the second sheet path, the guide member being placed at an opening position for guiding the recording sheet in directions substantially parallel to the first sheet path and a closing position for guiding the recording sheet to the joining position. According to the configuration, even when sheet jamming occurs, the jammed sheet can be easily removed away after the guide member is set to the opening position.

Moreover, the printer further comprises an urging member, which urges the guide member toward one of the opening position and the closing position.

Moreover, the printer further comprises:

a carriage, on which the print head is mounted, adapted to reciprocally move in directions substantially perpendicular to the first direction and the second direction; and a pivotable guide operator, provided with a first engagement member adapted to be engaged with the carriage and a second engagement member adapted to be engaged with the guide member, wherein the guide operator is pivoted by engaging the first engagement member with the carriage when the carriage is moved to a predetermined position, so that the second engagement member engages with the guide member to displace the guide member against an urging force of the urging member.

According to the configuration, the guide member can be switchingly operated simply by controlling the position of the carriage.

Preferably, the printer as set forth further comprises a guide controller, which places the guide member to the closing position after a leading end of the recording sheet transported in the second direction along the guide member placed at the opening position passes an end portion of the guide member which is closer to the joining position. According to the configuration, it is possible to prevent sheet jamming from occurring when the trailing end portion of the recording sheet enters the first sheet path from the second sheet path.

Preferably, the guide controller places the guide member to the opening position in a case where a leading end of the recording sheet is transported in the first direction when the trailing end of the recording sheet situates a position closer to the print head than the joining position. According to the configuration, the recording sheet can be smoothly transported without being bent at the joining position, and the print surface of the recording sheet can be protected.

Moreover, the printer further comprises a positioning stopper, placed at a position projecting into the first sheet path and a position retracted from the first sheet path. The positioning stopper forming the second sheet path together with the guide member placed at the closing position.

Also, the printer may further comprise a print controller, which controls the printer to perform printing on a first face of the recording sheet transported along the first sheet path, and to perform printing on a second face of the recording sheet transported by way of the second sheet path.

Preferably, the print head and the first roller are arranged in the same side with respect to the first sheet path. According to the configuration, printing can be performed on both faces of the recording sheet irrespective of the transportation direction of the recording sheet.

BRIEF DESCRIPTION OF THE DRAWINGS

FIG. 26 is a perspective view of the sheet path switching mechanism showing a first sheet path selecting state.

FIG. 27 is a perspective view of the sheet path switching mechanism showing a second sheet path selecting state.

BEST MODE FOR CARRYING OUT THE INVENTION

Figure 1:
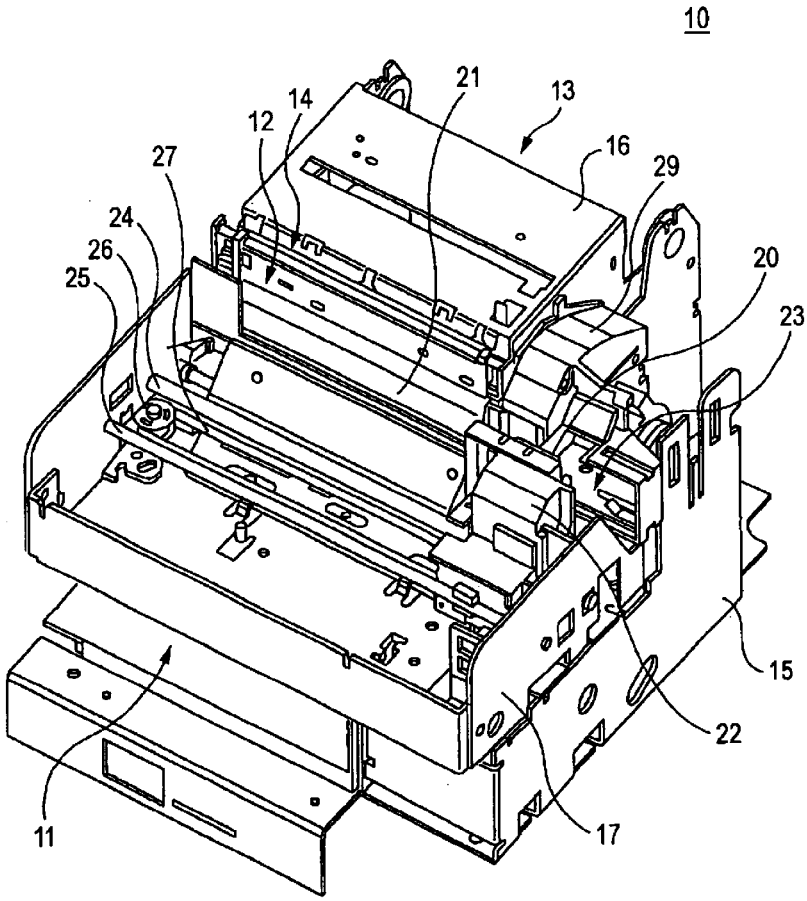
FIG. 1 is a perspective view of a printer which is an embodiment of the invention.

Hereinafter, an embodiment of the invention will be described with reference to the drawings. FIG. 1 is a perspective view of a printer which is an embodiment of the invention. The printer 10 can perform printing on a cut sheet such as a check, and a continuous sheet such as a rolled sheet, and has a cut sheet inlet 11 into which a check M is to be inserted, and a rolled sheet housing 13 which houses a rolled sheet R. A cut sheet transport path and a rolled sheet transport path are configured so that the check M which is inserted from the cut sheet inlet 11, and the rolled sheet R which is pulled out from the rolled sheet housing 13 are transported with passing over a common printing position. In the printing position, as described later, a print head 20 and a platen 21 are opposed to each other in a close proximity condition. The check M which is inserted from the cut sheet inlet 11 is transported by a cut sheet transporting roller pair 35, and then discharged from a cut sheet outlet 12 via the common printing position. On the other hand, the rolled sheet R which is pulled out from the rolled sheet housing 13 is transported by a rolled sheet transporting roller pair (not shown), and then discharged from a rolled sheet outlet 14 via the common printing position and a cutter mechanism (not shown).

A cover frame 16 which closes and opens the rolled sheet housing 13 is attached in a vertically pivotable manner to a rear portion of a main frame 15 which is formed into an approximately box-like shape. When the cover frame 16 is opened, replacement of the rolled sheet R or maintenance of the interior of the printer is performed, and, when the cover frame 16 is closed, the platen 21 disposed on the cover frame 16 is opposed to the print head 20 in a close proximity condition. The print head 20 is disposed on a carriage 22 which is reciprocally moved in the lateral directions (the width direction of the transport path), and performs dot matrix printing on another face of a sheet one face of which is pressed by the platen 21.

A carriage frame 17 comprising a carriage moving mechanism 23 is disposed in an upper portion of the main frame 15. The carriage 22 is supported so as to be laterally movable by a pair of front and rear carriage shafts 24 and 25 which are parallel to each other, and moved in accordance with driving of the carriage moving mechanism 23. The carriage moving mechanism 23 comprises: a pair of right and left pulleys 26 which are disposed on the carriage frame 17; a belt 27 which is wound around the pulleys 26, and which is connected at a predetermined position to the carriage 22; and a carriage motor 28 which rotates one of the pulleys 26 forwardly and reversely. The carriage 22 is laterally moved in accordance with the forward and reverse driving of the carriage motor 28.

The printing method of the print head 20 is of the ink jet type in which ink drops are jetted from ink nozzles formed in a nozzle face to perform printing on a sheet. A maintenance mechanism 29 which comprises: a nozzle cap that covers the nozzle face of the print head 20; an ink suction pump which sucks the ink from the ink nozzles via the nozzle cap; and a nozzle cleaner which wipes the nozzle face is disposed on the right side of the platen 21.

(First Embodiment)

Figure 2:
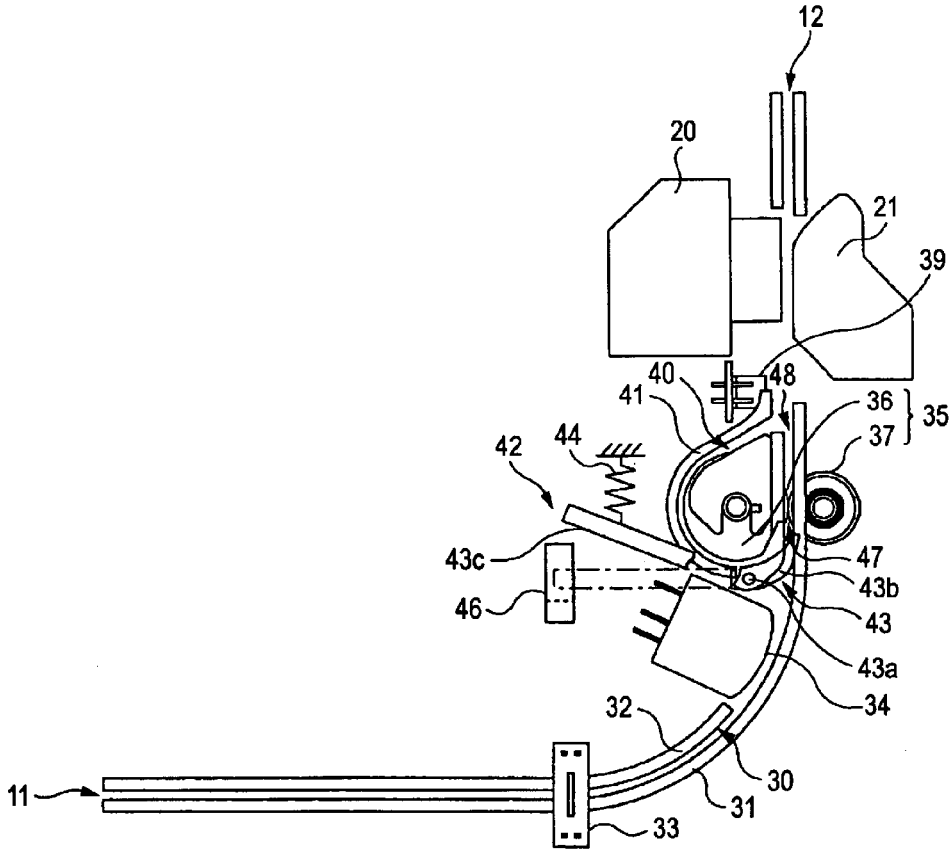
FIG. 2 is a schematic side view showing the inside of a printer of a first embodiment.

FIG. 2 is a schematic side view showing the inside of a printer according to a first embodiment. In the printer 10, a first sheet path 30 which has a substantially L-like shape in a side view, and which elongates from the cut sheet inlet 11 (hereinafter, often referred to merely as "inlet") to the cut sheet outlet 12 (hereinafter, often referred to merely as "outlet") is formed by first sheet guide members 31 and 32. On the first sheet path 30, a first sheet detector 33, a magnetic head 34, the cut sheet transporting roller pair 35 (hereinafter, often referred to merely as "transporting roller pair"), a second sheet detector 39, and the print head 20 are sequentially arranged with starting from the side of the inlet 11.

The first and second sheet detectors 33 and 39 are configured by, for example, photosensors of the transmission type or the reflection type, and detect the existence of the check M in the respective positions of the first sheet path 30. Information such as the account number is recorded by magnetic ink in a magnetic ink character recording area of the front face of the check M. The magnetic head 34 reads the magnetic ink characters. When the read data are inquired, the validity or invalidity of the check M can be recognized. The transporting roller pair 35 is configured by a driving roller 36, and a press roller 37 which is pressingly contacted with the driving roller, and clamps and transports the check M in accordance with driving of the driving roller 36. The power of a sheet feeding motor 38 configured by a stepping motor is transmitted to the driving roller 36 via a gear train 73.

In the following description, with respect to the rotation directions of the sheet feeding motor 38 and the driving roller 36 which is rotated by the sheet feeding motor 38, the direction along which a leading end Mt of the check M that is inserted from the inlet 11 into the first sheet path 30 as a front end is transported to the downstream side (toward the outlet 12) of the first sheet path 30 is referred to as "forward rotation (forward direction)", and that along which the check M is transported to the upstream side (toward the inlet 11) is referred to as "reverse rotation (reverse direction)".

A second sheet guide member 41 which forms a loop-like (arcuate) second sheet path 40 that branches off from the first sheet path 30 and then again joins the first sheet path 30 is disposed around the driving roller 36. A sheet path switching mechanism 42 comprising a switching plate 43 having a width which is approximately equal to the width of the first sheet path 30 is disposed upstream from the transporting roller pair 35. The switching plate 43 supported so as to be pivotable about a pivot 43*a* is formed with: a switch arm 43*b* rearwardly elongating from the pivot 43*a*; and an operation arm 43*c* forwardly elongating from the pivot 43*a*. The switching plate 43 is switched over between a posture in which the switch arm 43*b* protrudes into the first sheet path 30 to select the second sheet path 40, and that in which the switch arm 43*b* retracts from the first sheet path 30 to select the first sheet path 30. When the operation arm 43*c* is upwardly urged by a tension coil spring 44, the switch arm 43*b* protrudes into the first sheet path 30 to cooperate with the second sheet guide member 41 to form the second sheet path 40 (second sheet path selecting posture). When the operation arm 43*c* is downward pulled by a solenoid 45 against the urging force of the tension coil spring 44, the switch arm 43*b* retracts from the first sheet path 30 to form the first sheet path 30 (first sheet path selecting posture).

The position of the operation arm 43*c* is detected by a sheet path switching detector 46 which is configured by, for example, a photosensor of the transmission type or the reflection type, whereby the posture of the switch arm 43*b* can be known, and hence it is possible to know the selection state (switching state) of the first/second sheet paths 30 and 40. The sheet path switching detector 46 also detects existence of the check M in the first sheet path 30. When the check M is inserted from the inlet 11 into the first sheet path 30, the switch arm 43*b*, which protrudes into the first sheet path 30, is pivoted by the thickness of the check M against the urging force of the tension coil spring 44, to retract from the first sheet path 30. Therefore, existence of the check M can be judged on the basis of a detection signal of the sheet path switching detector 46 which detects the position of the operation arm 43*c*.

In the following description, the sheet path branching position 47 means a junction which is positioned between the switching plate 43 (67) and the transporting roller pair 35, and at which the first sheet path 30 and the second sheet path 40 branch off from each other. In the position, the pivot of the switching plate 43 (67) is not obstructed by the trailing end Mb of the check M which is positioned downstream from the switching plate 43 (67). The sheet path joining position 48 means a juncture which is positioned between the transporting roller pair 35 and the print head 20, and at which the first sheet path 30 and the second sheet path 40 join each other.

Figure 3:
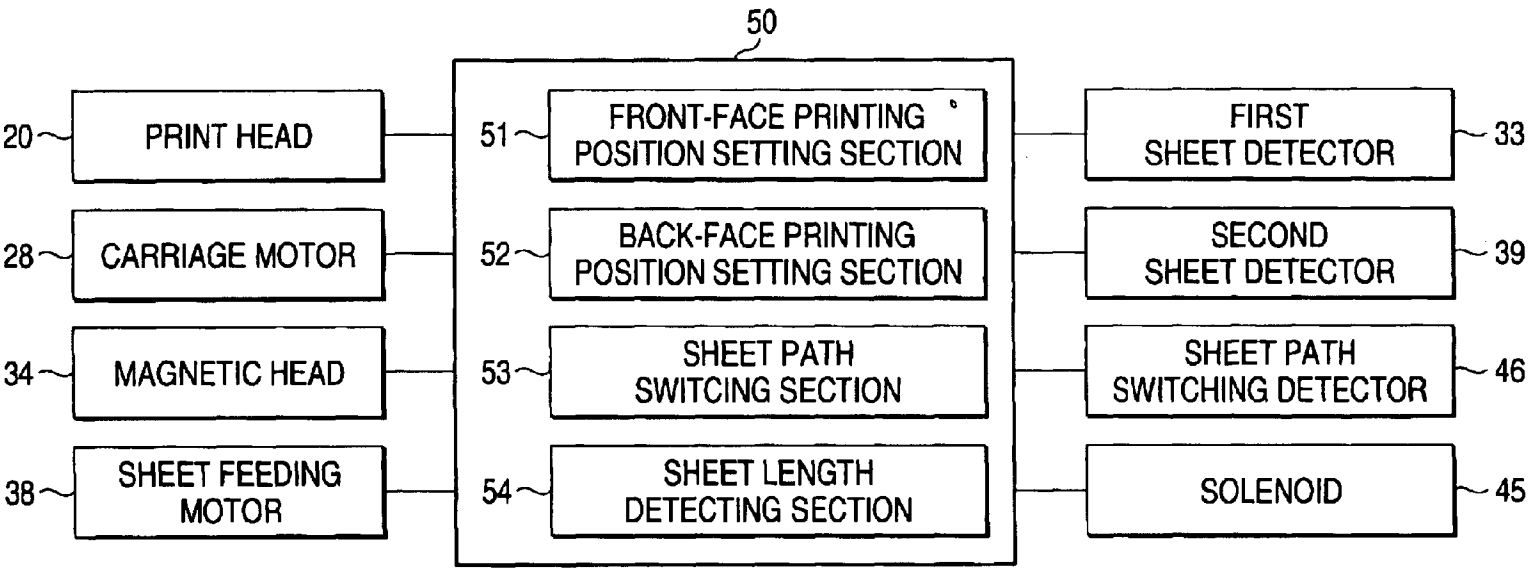
FIG. 3 is a control block diagram of the printer of the first embodiment.

FIG. 3 is a control block diagram of the printer of the first embodiment. The printer 10 comprises a control section 50 configured by a CPU, a ROM, a RAM, etc. The first sheet detector 33, the magnetic head 34, the second sheet detector 39, the print head 20, the carriage motor 28, the sheet feeding motor 38, the solenoid 45, the sheet path switching detector 46, and the like which are described above are connected to the control section 50. The control section 50 has a front-face printing position setting section 51, a back-face printing position setting section 52, a sheet path switching section 53, and a sheet length detecting section 54 which respectively control a front-face printing position setting process, a back-face printing position setting process, a sheet path switching process, and a sheet length detecting process that will be described later. Hereinafter, a control procedure of a checking process which is executed by the control section 50 will be described with reference to flowcharts.

Figure 4:
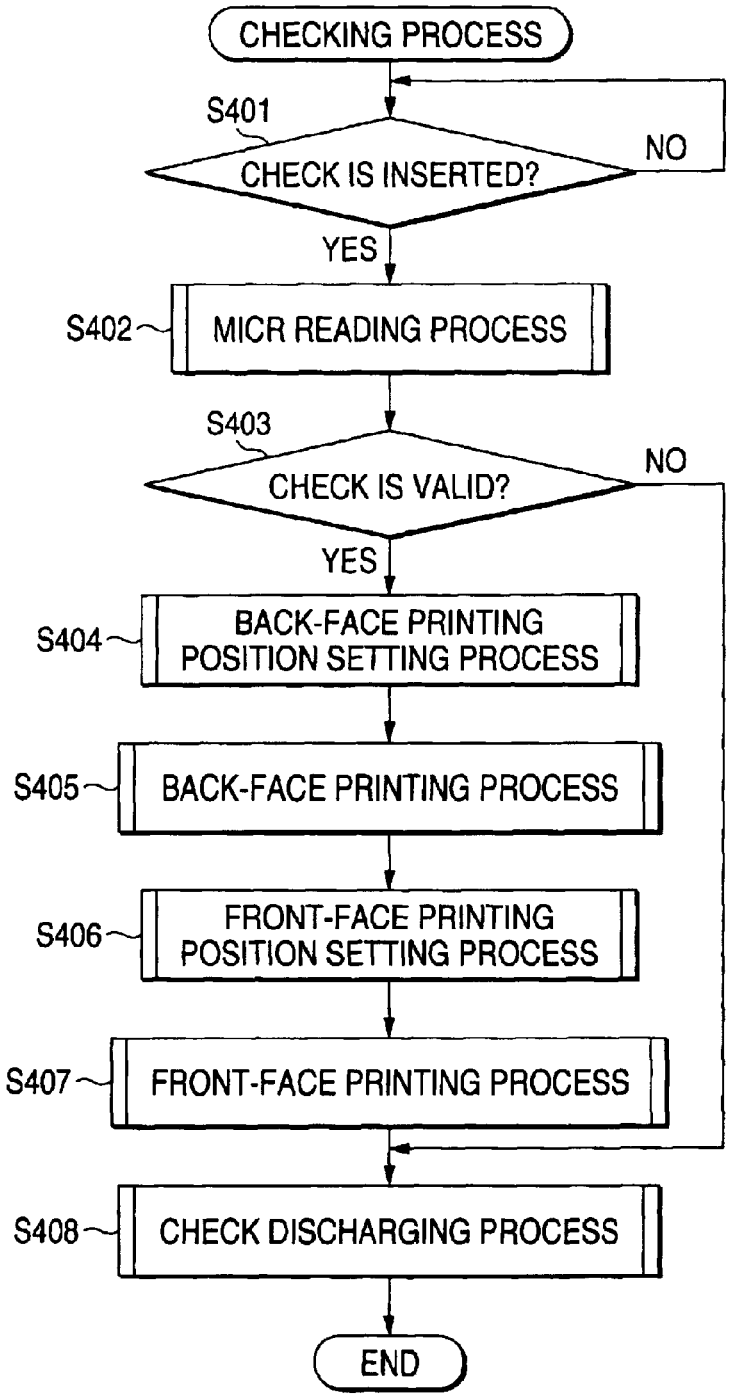
FIG. 4 is a flowchart showing a control procedure of a checking process.

FIG. 4 is a flowchart showing the control procedure of the checking process. This control is executed in response to reception of a control command from a host apparatus (not shown), such as an MICR (Magnetic Ink Character Recognition) reading command, front face/back face print commands, and a sheet discharge command. When the MICR reading command is received, the printer 10 enters a state of waiting insertion of the check M (S401). When the check M is inserted from the inlet 11, the check M is transported along the first sheet path 30 to position an MICR reading starting position M1 of the check M on the magnetic head 34. While the check M is further transported toward the outlet 12 along the first sheet path 30, magnetic ink characters of the check M are read by the magnetic head 34 (S402; MICR reading process). The data read by the magnetic head 34 are transmitted to the host apparatus, and the validity or invalidity of the check M is then judged.

If the check M is invalid (S403; No), the check M is discharged from the outlet 12 in accordance with the sheet discharge command from the host apparatus (S408; discharging process), and the checking process is terminated.

By contrast, if the check M is valid (S403; Yes), the sheet path switching mechanism 42 selects the second sheet path in accordance with the back-face printing command from the host apparatus, a portion of the check M on the side of the trailing end Mb is transported from the sheet path branching position 47 into the second sheet path 40, and the check M is then returned into the first sheet path 30 from the sheet path joining position 48 so that a back-face printing starting position M2 of the back face of the check M is opposed to the print head 20 (S404; back-face printing position setting process). While a portion of the check M on the side of the trailing end Mb is transported to the outlet 12 along the first sheet path 30, endorsements such as the authentication number, the date, and the amount are printed (endorsement printing), and, after printing by the print head 20, the trailing end Mb of the check M is returned to the sheet path branching position 47 (S405; back-face printing process).

When the back-face printing process is finished, the sheet path switching mechanism 42 selects the first sheet path 30 in accordance with the front-face printing command from the host apparatus, and the check M is transported along the first sheet path 30 so that a front-face printing starting position M3 of the front face of the check M is opposed to the print head 20 (S406; front-face printing position setting process). Then, cover items such as the payee, the date, and the amount are printed on the front face of the check M by the print head 20 while the side of the leading end Mt of the check M is transported toward the outlet 12 along the first sheet path 30 (S407; front-face printing process).

When the front-face printing process is finished, the check M is discharged from the outlet 12 in accordance with the discharging command from the host apparatus (S408; discharging process), and the checking process is terminated.

Figure 5:
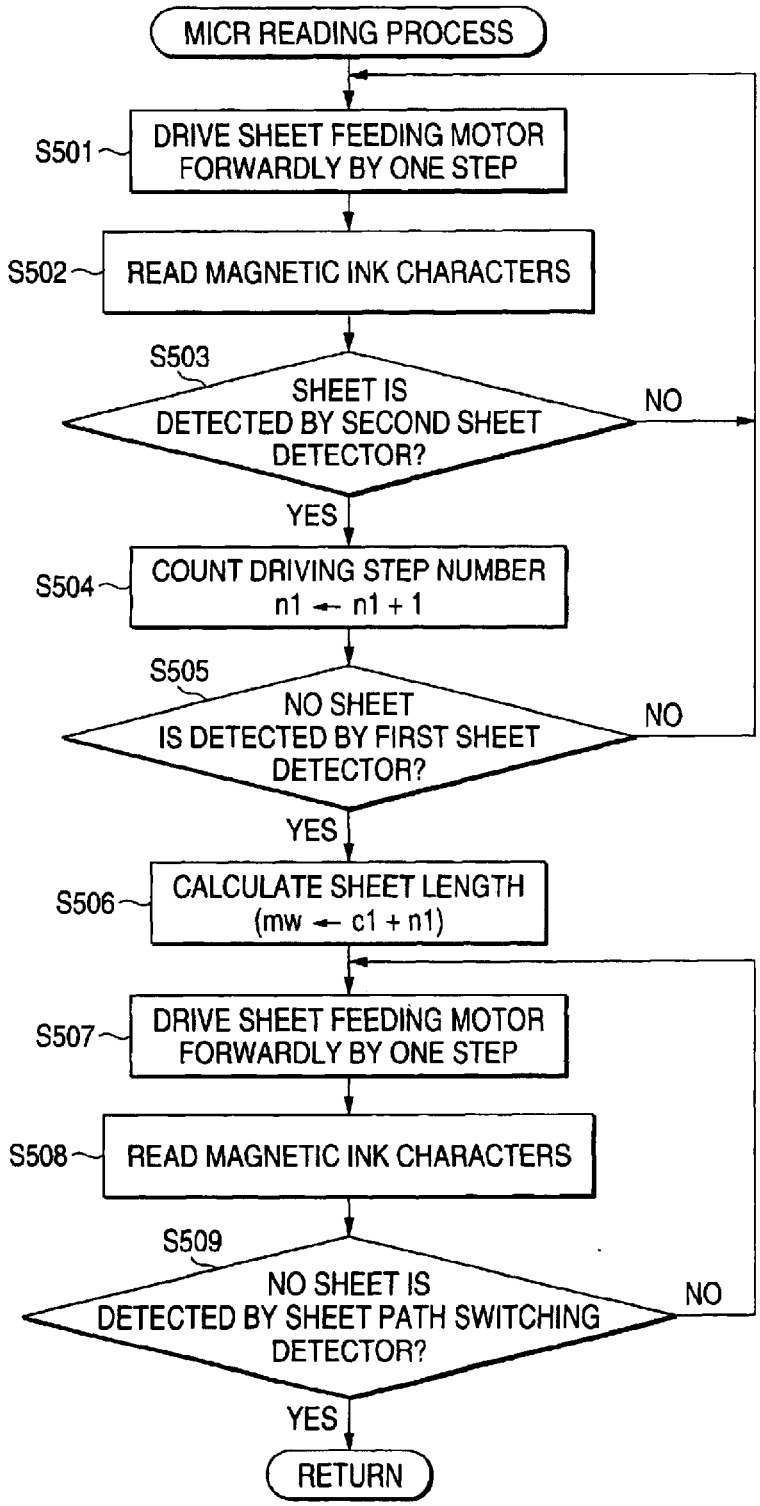
FIG. 5 is a flowchart showing a control procedure of an MICR reading process in the first embodiment.
Figure 9C:
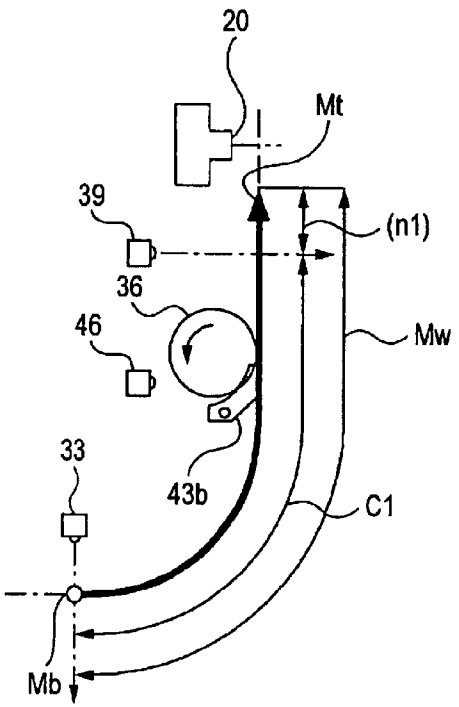
FIGS. 9A–C show the operation of the MICR reading process in the first embodiment.
Figure 9B:
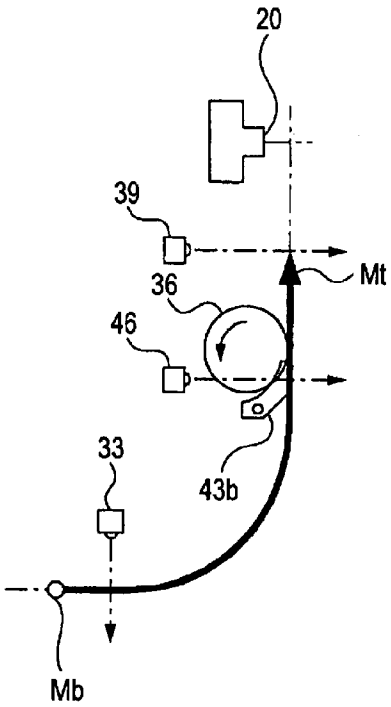
Figure 9A:
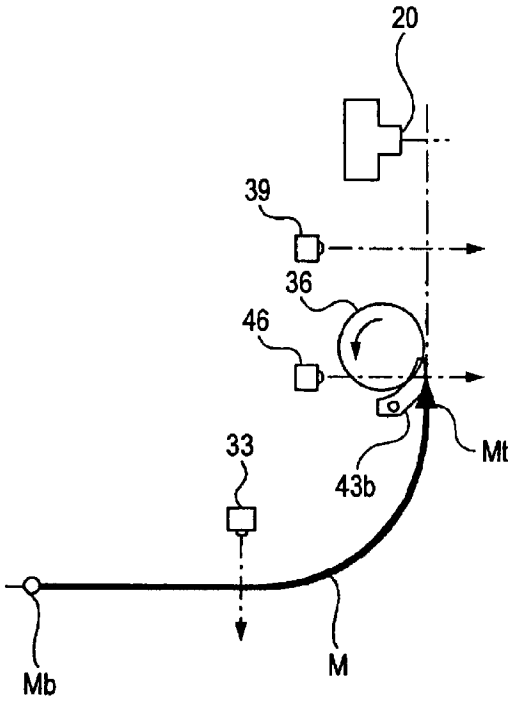

Hereinafter, the control procedure of the above-mentioned processes will be described in detail with reference to flowcharts. FIG. 5 is a flowchart showing the control procedure of the MICR reading process in the first embodiment, and FIG. 9 is a diagram showing the operation of the MICR reading process in the first embodiment. When the check M is inserted from the inlet 11 and the insertion of the check M is judged on the basis of the detection signals of the first sheet detector 33 and the sheet path switching detector 46 (FIG. 9A), the sheet feeding motor 38 is forwardly driven by one step to forward rotate the driving roller 36, whereby the check M is caused to be clampingly held by the driving roller 36 and the press roller 37 and transported toward the outlet 12 along the first sheet path 30 (S501). Magnetic ink characters recorded on the front face of the check M are read by the magnetic head 34 (S502). The process of steps S501 and S502 is repeatedly performed until the leading end Mt of the check M reaches the detecting position of the second sheet detector 39 (S503; No).

If it is judged on the basis of the detection signal of the second sheet detector 39 that the leading end Mt of the check M is detected (if it is judged that a sheet exists) (S503; Yes, FIG. 9B), the counting of the driving step number n1 of the sheet feeding motor 38 is started by a counter (not shown) provided in the control section 50 (5504). In the counting of the driving step number of the sheet feeding motor 38, addition is conducted in the case of forward rotation, and subtraction is conducted in the case of reverse rotation. As a result, with using the detecting position of the second sheet detector 39 as a reference, setting of the positions of the check M can be performed on the basis of the transportation driving step number from the reference position. The process of steps 5501 to 5504 is repeatedly performed until the trailing end Mb of the check M reaches the detecting position of the first sheet detector 33 (S505; No). If it judged on the basis of the detection signal of the first sheet detector 33 that the trailing end Mb of the check M is detected (if no sheet is judged) (S505; Yes, FIG. 9C), a sum mw (=c1+n1) of a value c1 which is the driving step number of the sheet feeding motor 38 corresponds to the path length C1 of the first sheet path 30 between the first and second sheet detectors 33 and 39, and the driving step counted value n1 counted by the counter is calculated, thereby detecting (calculating) the sheet length Mw of the check M (S506).

Thereafter, until the trailing end Mb of the check M reaches the detecting position of the sheet path switching detector 46 (S509; No), magnetic ink characters recorded on the check M are read by the magnetic head 34 (S508) while the check M is transported step by step toward the outlet 12 (S507), in the same manner as above-described steps S501 and S502. If it is judged on the basis of the detection signal of the sheet path switching detector 46 that the trailing end Mb of the check M is detected (if no sheet is judged) (S509; Yes), the MICR reading process is finished.

When the MICR reading process is finished, the check M is stopped in the first sheet path 30 in the state in which the trailing end Mb is positioned in the sheet path branching position 47. The switch arm 43*b* has a posture in which the operation arm 43*c* is urged by the tension coil spring 44 to protrude into the first sheet path 30.

As described above, in the MICR reading process, the process of detecting the sheet length Mw of the check M is executed in parallel with the process of reading magnetic ink characters of the check M. Alternatively, the two processes may be independently performed. For example, the detection of the sheet length may be first performed, and the reading of magnetic ink characters may be then conducted.

Figure 6:
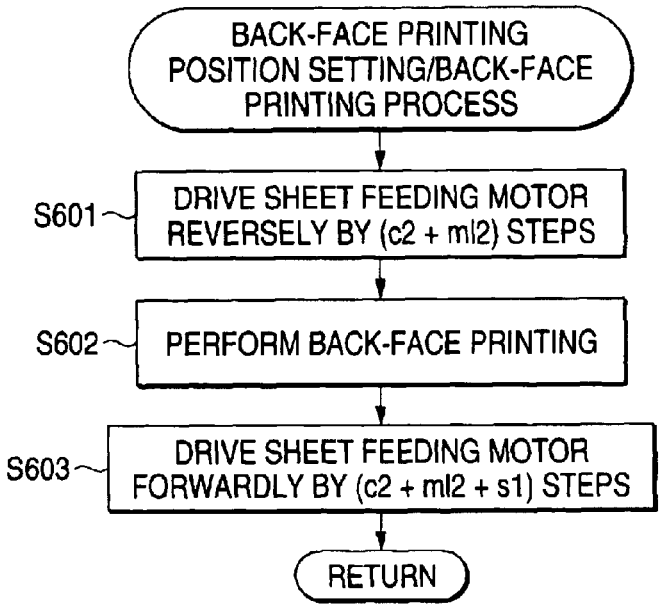
FIG. 6 is a flowchart showing a control procedure of a back-face printing position setting/back-face printing process in the first embodiment.
Figure 10C:
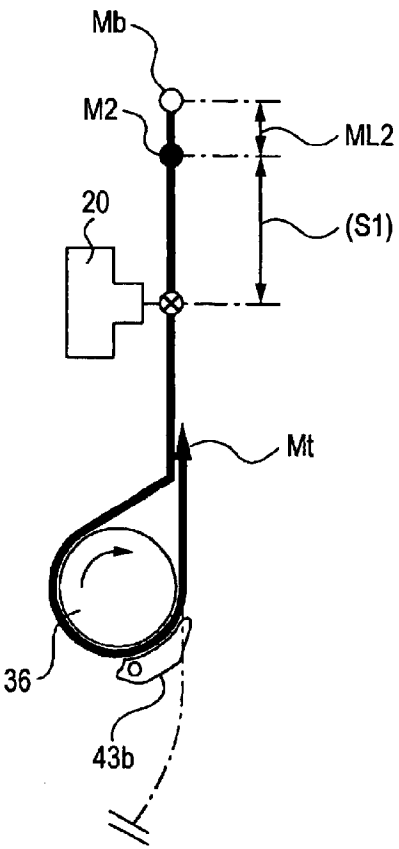
FIGS. 10A–C show the operation of the back-face printing position setting/back-face printing process in the first embodiment.
Figure 10B:
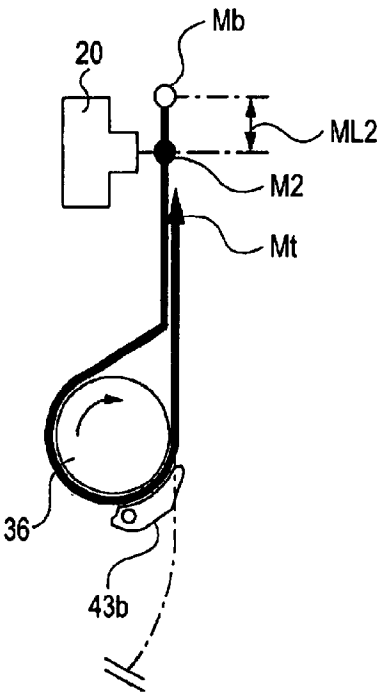
Figure 10A:
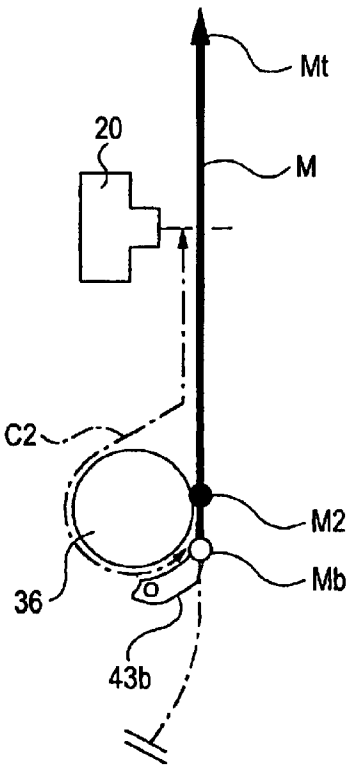

FIG. 6 is a flowchart showing a control procedure of the back-face printing position setting/back-face printing process in the first embodiment, and FIG. 10 is a diagram showing the operation of the back-face printing position setting/back-face printing process in the first embodiment. As described above, at the timing when the MICR reading process is finished, the trailing end Mb of the check M is positioned in the sheet path branching position 47, and the switch arm 43*b* has the second sheet path selecting posture in which the switch arm 43*b* protrudes into the first sheet path 30 (FIG. 10A). When the sheet feeding motor 38 is reversely driven to reversely rotate the driving roller 36 in this positional relationship, the check M is transported into the second sheet path 40, starting from the side of the trailing end Mb, and then returned into the first sheet path 30. As a result, the back face of the check M faces the print head 20. At this time, the transportation distance of the check M equals to a sum of the path length C2 from the sheet path branching position 47 to the print head 20 via the second sheet path 40, and the length ML2 between the trailing end Mb of the check M and the back-face printing starting position M2. Therefore, the distance sum (C2+ML2) is converted into the driving step number of the sheet feeding motor 38, and the sheet feeding motor 38 is reversely driven by the step number (c2+ml2), whereby the check M is transported until the back-face printing starting position M2 is opposed to the print head 20 (S601, FIG. 10B).

In succession to the back-face printing position setting process of step S601, the print head 20 is driven to perform the back-face printing while the check M is transported with directing the trailing end Mb to the outlet 12 by reversely driving the sheet feeding motor 38 to reversely rotate the driving roller 36 (S602, FIG. 10C). After the back-face printing is finished, in order to return the check M until the trailing end Mb is positioned at the sheet path branching position 47, the sheet feeding motor 38 is forwardly driven by the step number (c2+ml2+s1) which is a sum of the step number (c2+ml2) of the transportation in the back-face printing position setting at step S601 and the step number s1 of the transportation in the back-face printing at step S602, to forward rotate the driving roller 36, whereby the check M is transported with directing the leading end Mt to the outlet 12 (S603, see FIG. 10A).

Figure 7:
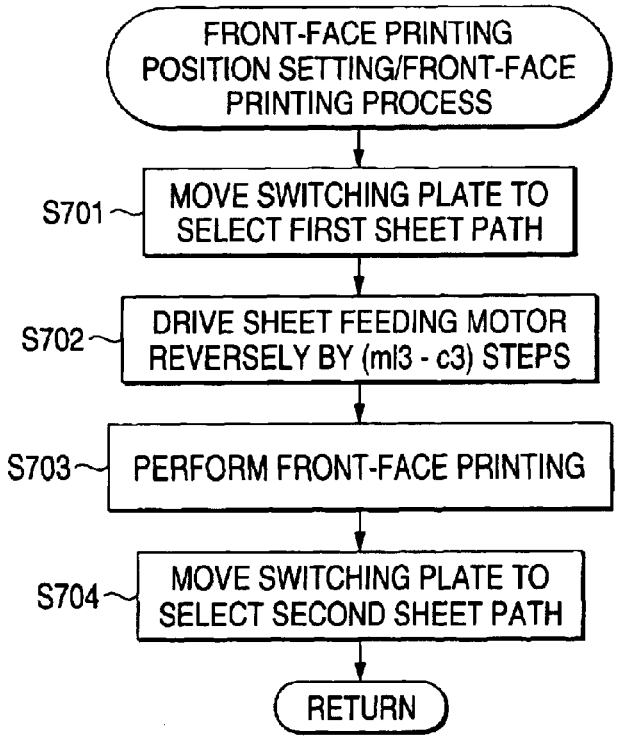
FIG. 7 is a flowchart showing a control procedure of a front-face printing position setting/front-face printing process in the first embodiment.
Figure 11A:
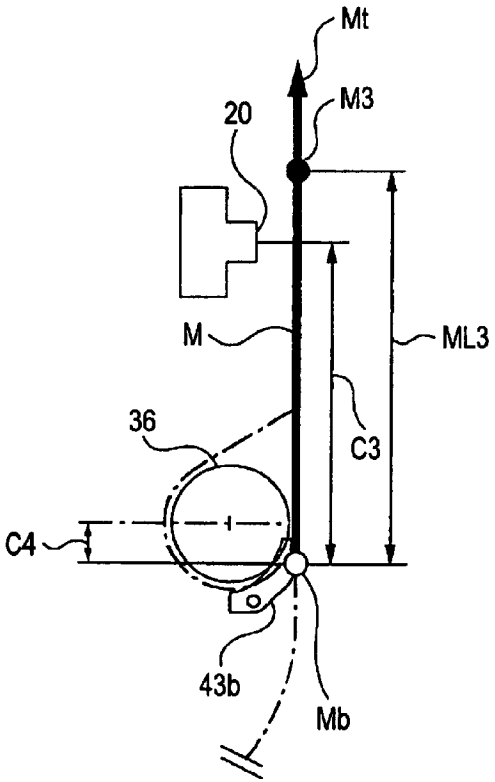
FIGS. 11A–C show the operation of the front-face printing position setting/front-face printing process in the first embodiment.
Figure 11B:
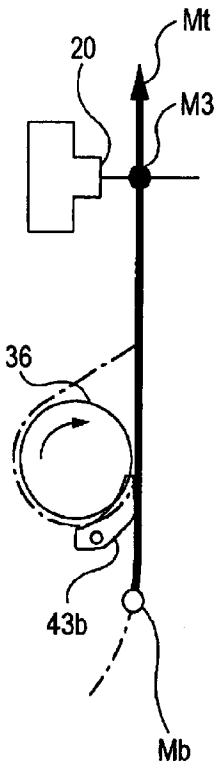

FIG. 7 is a flowchart showing a control procedure of the front-face printing position setting/front-face printing process in the first embodiment, and FIG. 11 is a diagram showing the operation of the front-face printing position setting/front-face printing process in the first embodiment. At the timing when the back-face printing process is finished, the trailing end Mb of the check M is positioned in the sheet path branching position 47, and the switch arm 43*b* has the second sheet path selecting posture in which the switch arm 43*b* protrudes into the first sheet path 30. First, the operation arm 43*c* is pulled by the solenoid 45 to retract the switch arm 43*b* from the first sheet path 30, thereby changing the posture of the switch arm 43*b* to the first sheet path selecting posture (S701, FIG. 11A). When the sheet feeding motor 38 is reversely driven to reversely rotate the driving roller 36 in this state, the front-face printing starting position M3 of the check M is opposed to the print head 20. At this time, the transportation distance of the check M equals to a difference between the length ML3 between the trailing end Mb of the check M and the front-face printing starting position M3, and the path length C3 of the first sheet path 30 from the sheet path branching position 47 to the print head 20. Therefore, the distance difference (ML3−C3) is converted into the driving step number of the sheet feeding motor 38, and the sheet feeding motor 38 is reversely driven by the step number (ml3−c3), whereby the check M is transported until the front-face printing starting position M3 is opposed to the print head 20 (S702, FIG. 11B).

Figure 11C:
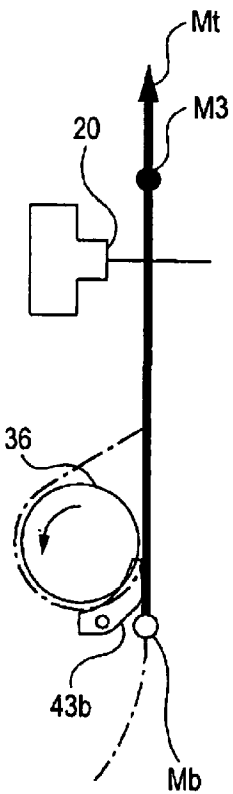

Then, the print head 20 is driven to perform the front-face printing while the check M is transported with directing the leading end Mt to the outlet 12 by forward driving the sheet feeding motor 38 to forwardly rotate the driving roller 36 (S703, FIG. 11C). After the front-face printing is finished, the pulling of the operation arm 43*c* by the solenoid 45 is cancelled (S704).

Figure 8:
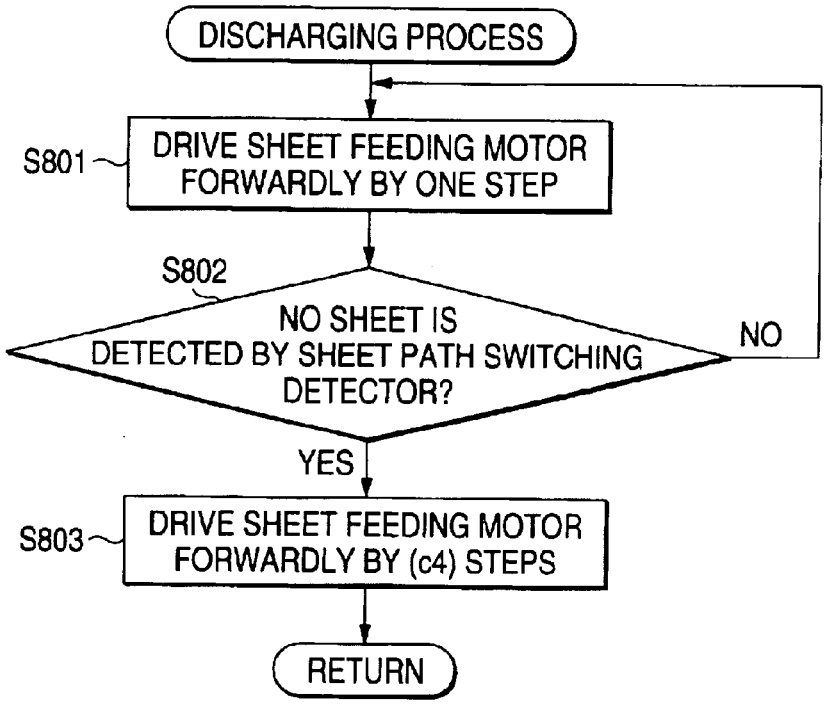
FIG. 8 is a flowchart showing a control procedure of a discharging process in the first embodiment.

FIG. 8 is a flowchart showing a control procedure of the discharging process in the first embodiment. In the case where the check M is invalid, the forward driving of the sheet feeding motor 38 is started to transport the check M toward the outlet 12. When the check M is valid and the back-face printing process or the front-face printing process has been executed, the driving for transporting toward the outlet 12 is continued. Then, the check M is transported to a position where the trailing end Mb of the check M is clampingly held by the transporting roller pair 35. Namely, on the basis of the detection signal of the sheet path switching detector 46, the check M is transported until the trailing end Mb is positioned in the sheet path branching position 47 (S801, S802). In succession, the sheet feeding motor 38 is forwardly rotated by a step number c4 which is obtained by converting the path length C4 of the first sheet path 30 from the sheet path branching position 47 to the transporting roller pair 35, into the driving step number of the sheet feeding motor 38, whereby the check M is discharged (S803). Taking out of the check M from the printer 10 can be judged on the basis of the detection signal of the second sheet detector 39.

Next, other examples of the printer will be sequentially described with reference to the drawings. In the description of the portions which are common to the first embodiment, the same drawings and reference numerals as those in the first embodiment are used, and the detailed description of the portions is omitted.

(Second Embodiment)

Figure 12:
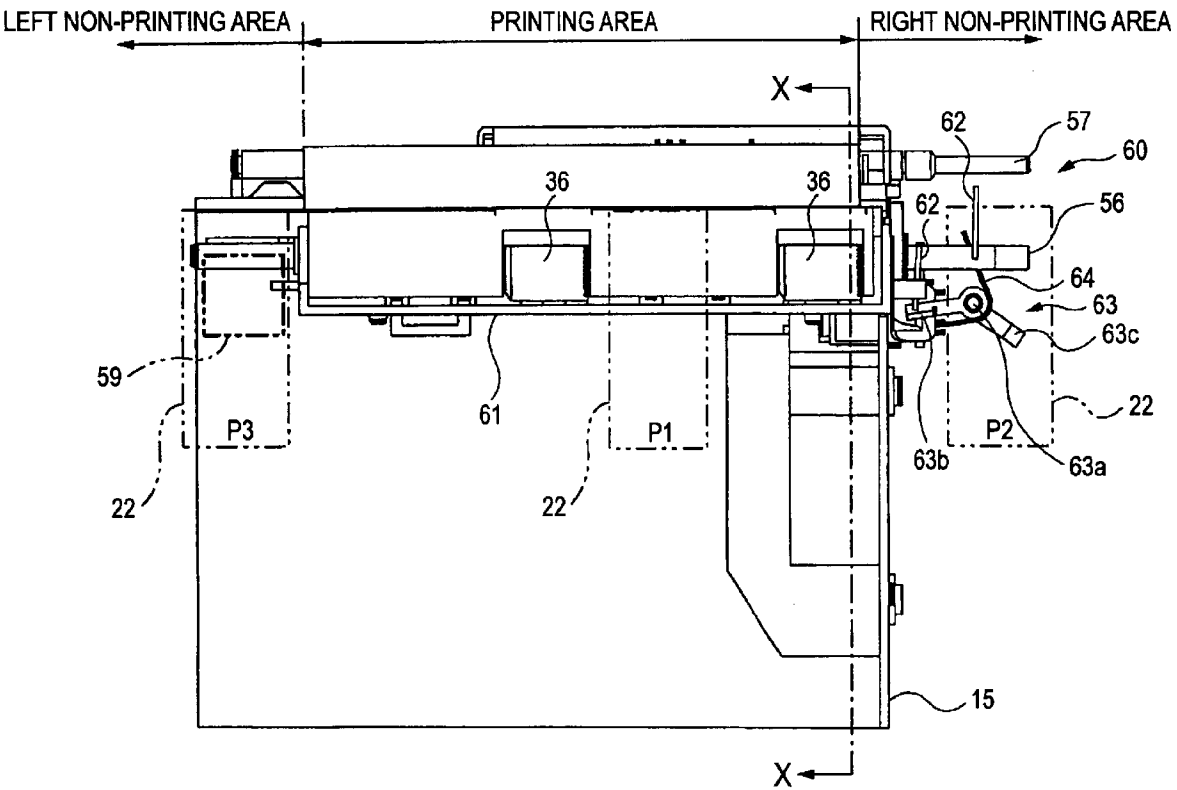
FIG. 12 is a schematic plan view showing the inside of a printer of a second embodiment.
Figure 13:
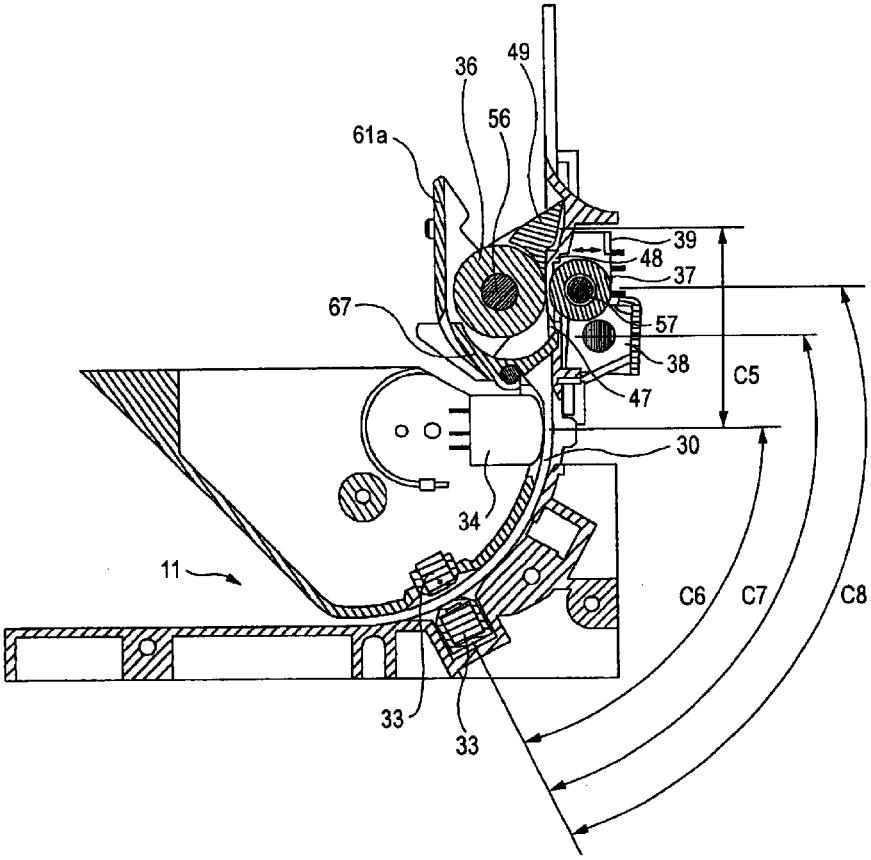
FIG. 13 is a sectional view along X—X and showing the inside of the printer of the second embodiment.

FIG. 12 is a schematic plan view showing the inside of a printer of a second embodiment, and FIG. 13 is a sectional view along X—X and showing the inside of the printer of the second embodiment. In the second embodiment, the press roller 37 is retractable with respect to the driving roller 36, and switchingly operated between a posture in which the press roller 37 presses the check M against the driving roller 36, and that in which the press roller 37 retracts from the driving roller 36 to allow the check M to pass therebetween. The driving roller 36 is disposed at plural places separated by predetermined intervals on a driving roller shaft 56 which is laterally elongated. By contrast, the press roller 37 is disposed at plural places separated by predetermined intervals on a press roller shaft 57 which is elongated in parallel to the driving roller shaft 56 at a rear side thereof. The press roller shaft 57 is disposed on a press roller frame 18 which is pivotable about a frame support shaft 18*a*, so as to advance and retract the press roller 37 with respect the driving roller 36. For example, the first sheet path 30 is opened and closed by the advancing and retracting operations according to the driving of an actuator such as a solenoid.

In the second embodiment, a positioning stopper 49 is placed downstream from the second sheet detector 39. The positioning stopper 49 is used for positioning the check M which is inserted from the inlet 11, and switchingly operated between a posture in which the stopper 49 protrudes into the first sheet path 30 to engagingly hold the leading end Mt of the check M, and that in which the stopper 49 retracts from the first sheet path 30 to allow the check M to pass through. The positioning stopper 49 is disposed so as to be pivotable about the driving roller shaft 56. The positioning stopper 49 is caused to protrude into the first sheet path 30 by the urging force of a spring which is not shown, and pivoted toward the retracting side against the urging force of the spring, by the thickness of the check M.

In the second embodiment, a reversing guide plate 61 which forms the second sheet path 40, and which will be described later is retractable with respect to the first sheet path 30, and switchingly operated between a closing position where the guide plate 61 joins the first sheet path 30 to form the second sheet path 40, and an opening position where the guide plate 61 retracts from the first sheet path 30 to be substantially parallel to the first sheet path 30. The sheet path switching mechanism 42 is switchingly operated in accordance with the movement of the carriage 22 in place of the switching operation of the solenoid 45 in the first embodiment. The embodiment is further different in that the sheet path switching detector 46 is not provided.

Figure 14A:
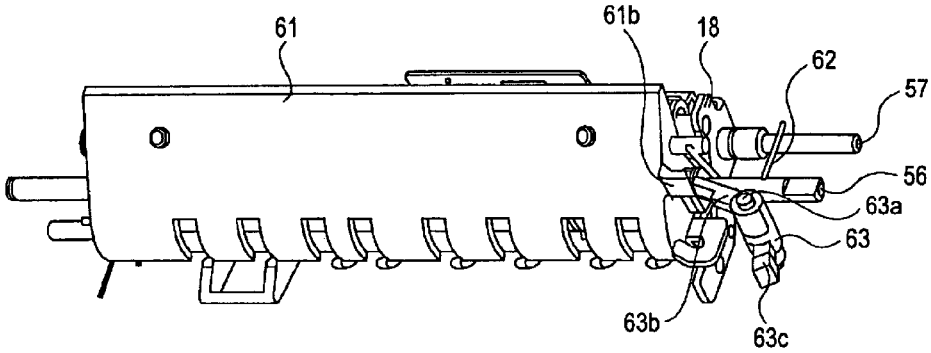
FIG. 14A is a perspective view showing a reversing guide open/close mechanism.
Figure 14B:
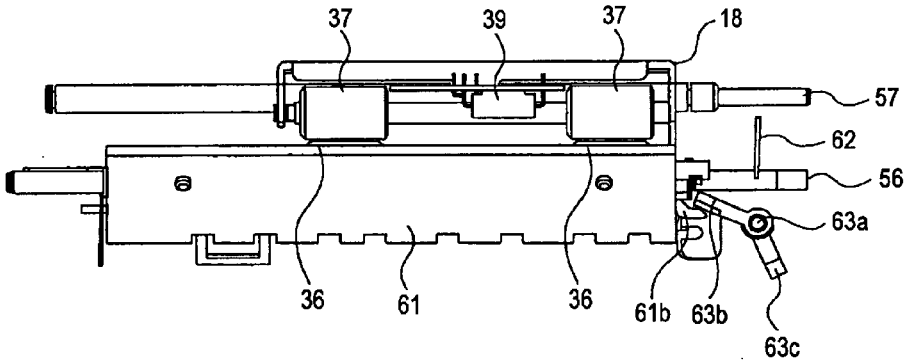
FIG. 14B is a plan view showing the reversing guide open/close mechanism.
Figure 15A:
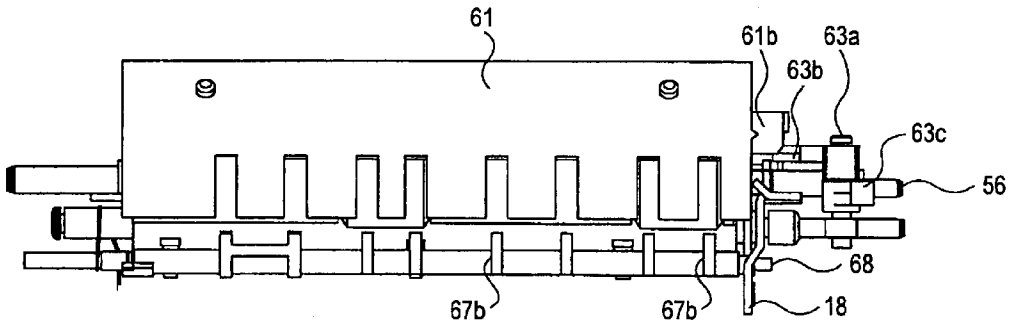
FIG. 15A is a front view showing the reversing guide open/close mechanism.
Figure 15C:
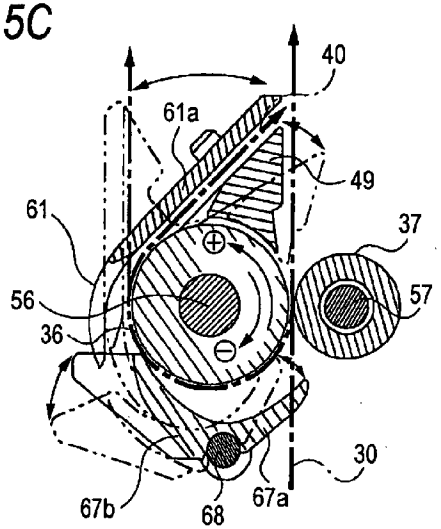
FIG. 15C is a right side sectional view showing the reversing guide open/close mechanism.
Figure 15B:
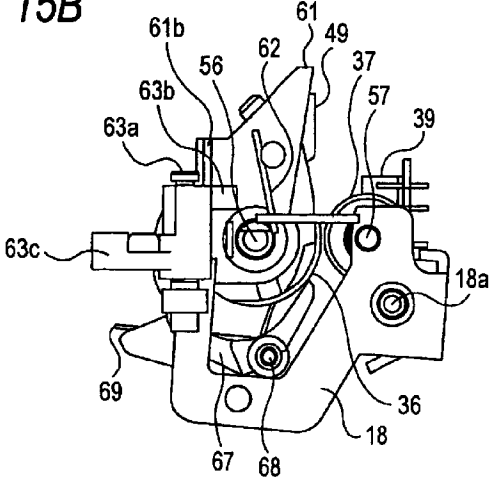
FIG. 15B is a right side view showing the reversing guide open/close mechanism.

FIG. 14A is a perspective view showing the reversing guide open/close mechanism, FIG. 14B is a plan view showing the reversing guide open/close mechanism, FIG. 15A is a front view showing the reversing guide open/close mechanism, FIG. 15B is a right side view showing the reversing guide open/close mechanism, and FIG. 15C is a right side sectional view showing the reversing guide open/close mechanism. The reversing guide plate 61 for forming the second sheet path 40 is pivotably supported on the driving roller shaft 56. In the reversing guide plate 61, a guide portion 61*a* having a width which is approximately equal to the width of the first sheet path 30 is formed so as to be substantially parallel to a tangential plane of the driving roller 36. The guide portion 61*a* is retractable with respect to the first sheet path 30, and switchingly operated between a closing position (indicated by the solid line in FIG. 15C) where the guide portion 61*a* joins the first sheet path 30 to form the second sheet path 40, and an opening position (indicated by the two-dot chain line in FIG. 15C) where the guide portion 61*a* retracts from the first sheet path 30 to be substantially parallel to the first sheet path 30. The reversing guide plate 61 is urged to the closing position by the urging force of a torsion coil spring 62.

An engaging protrusion 61*b* which protrudes to a right side is formed on a right end portion of the reversing guide plate 61. An operation lever 63 which is laterally pivotable about a vertically directed support shaft 63*a* is disposed in a right (in the example, the side of the home position) non-printing area in the movement area of the carriage 22. A first engaging piece 63*b* which is to be engaged with the engaging protrusion 61*b* of the reversing guide plate 61 is formed on an upper end portion of the operation lever 63, and a second engaging piece 63*c* which is to be engaged with the carriage 22 is formed on a lower end portion of the operation lever 63. The operation lever 63 is urged in a counterclockwise direction by a torsion coil spring 64, and the second engaging piece 63*c* is engaged from the rear side with the engaging protrusion 61*b* of the reversing guide plate 61. The urging force of the torsion coil spring 64 which urges the operation lever 63 in a counterclockwise direction is smaller than that of the torsion coil spring 62 which urges the reversing guide plate 61 to the closing position.

When the carriage 22 is moved to a position P2 in the right non-printing area, the carriage pushes rightward the second engaging piece 63*c* of the operation lever 63, and in accordance with this pushing the operation lever 63 leftward pivots so that the first engaging piece 63*b* pushes from the rear side the engaging protrusion 61*b*, whereby the reversing guide plate 61 is moved to the opening position. When the carriage 22 is moved leftward from the position P2 in the right non-printing area, the reversing guide plate 61 is urged by the torsion coil spring 64 to pivot, and then moved to the closing position. In this way, the reversing guide plate 61 is switchingly operated between the closing position where the upper end portion of the guide portion 61*a* joins the first sheet path 30, and the opening position where the upper end portion of the guide portion 61*a* retracts from the first sheet path 30 to be substantially parallel to the first sheet path 30. The reversing guide plate 61 which is in the closing position is opposed to the positioning stopper 49 to cooperate with the positioning stopper 49 to form the second sheet path 40.

A switching plate 67 has a width approximately equal to the width of the first sheet path 30, and is supported so as to be pivotable about a pivot shaft 68 which is placed below the driving roller shaft 56. The switching plate 67 has a substantially arcuate sectional shape. A first guide portion 67*a* for guiding the check M from the first sheet path 30 to the second sheet path 40 is formed in a rear end portion of the switching plate 67, and second guide portions 67*b* for guiding the check M to the reversing guide plate 61 are formed in a front end portion of the switching plate 67. The second guide portions 67*b* are upwardly urged by a torsion coil spring 69, so that the first guide portion 67*a* has a posture in which the guide portion 61*a* protrudes into the first sheet path 30 to select the second sheet path 40. Furthermore, the first guide portion 67*a* is switchingly operated to a posture in which the guide portion 61*a* retracts from the first sheet path 30 to select the first sheet path 30, by a cam member 59 (see FIG. 12) which is disposed in a left non-printing area, and which performs a switching operation in accordance with the movement of the carriage 22 to a position P3 in the left non-printing area.

Figure 16:
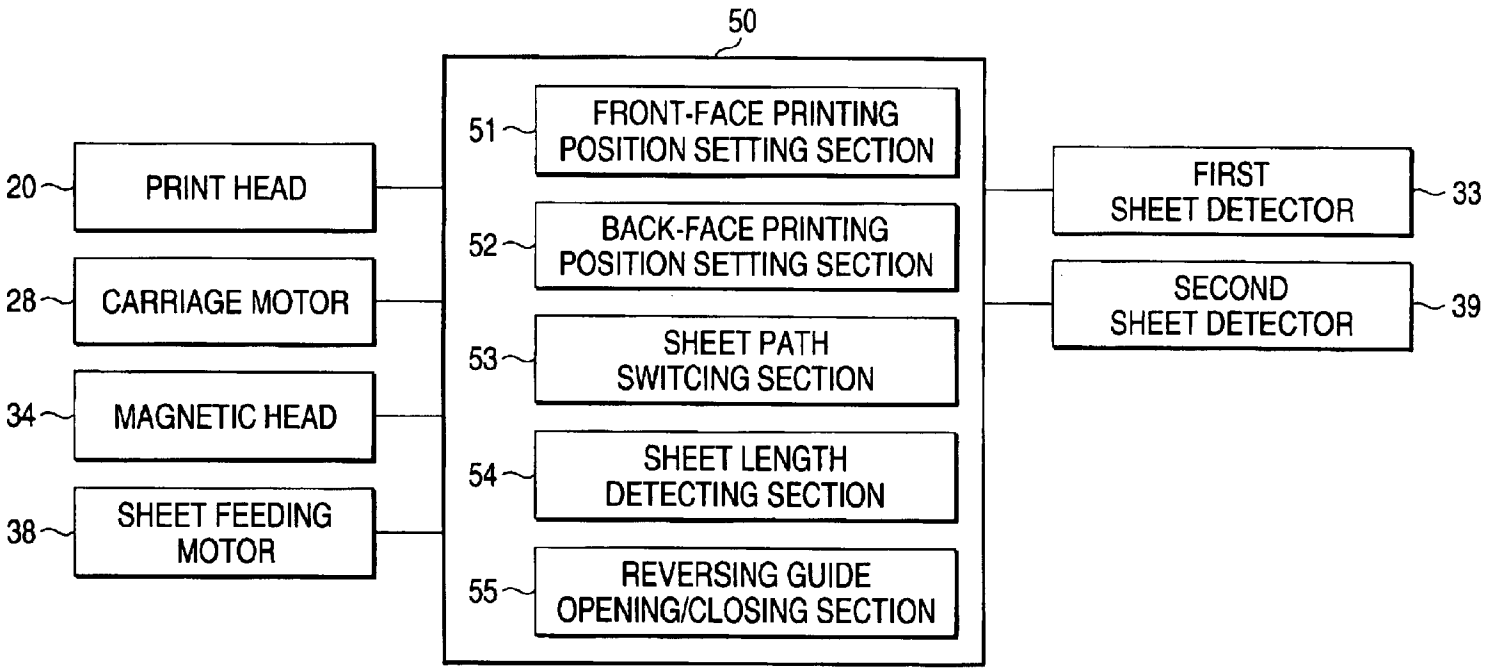
FIG. 16 is a control block diagram of the printer of the second embodiment.

FIG. 16 is a control block diagram of the printer of the second embodiment. The control section 50 has a reversing guide opening/closing section 55 which controls the opening and closing operations of the reversing guide plate 61, in addition to the sections 51 to 54 of the first embodiment as described later. In the second embodiment, as described above, the sheet path switching section 53 switches over the posture of the switching plate 67 by the control of the position of the carriage 22 in place of the driving control by the solenoid 45 as in the first embodiment. Hereinafter, the control procedure of the checking process executed by the control section 50 will be described with reference to flowcharts.

Figure 21A:
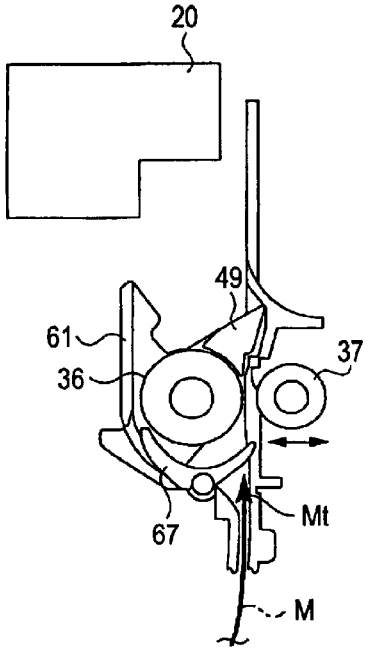
FIGS. 21A–D show the operation of a check reversing process in the second embodiment.

In the same manner as the first embodiment, when a checking process command (group) is received, the printer 10 enters the state of waiting insertion of the check M (S401). In the waiting state, the carriage 22 is positioned in the home position in the right non-printing area. Therefore, the reversing guide plate 61 is in the opening state, and the switching plate 67 is in the protruding state (second-sheet path selecting state). Since the positioning stopper 49 is urged by the spring, the stopper is in the protruding state, and the rollers 36 and 37 of the transporting roller pair 35 are switchingly operated into the opening state (see FIG. 21A).

When the check M is inserted from the inlet 11 into the first sheet path 30 and pushed into the position where the leading end Mt is engagingly held by the positioning stopper 49 while the switching plate 67 is pivoted against the urging force of the torsion coil spring 69, the insertion of the check M is judged on the basis of the detection signals of the first and second sheet detectors 33 and 39. In accordance with the judgment of the insertion of a check, the press roller frame 18 is pivoted, the gap between the rollers 36 and 37 is closed to clampingly hold the check M, and the process transfers to the MICR reading process (S402).

Figure 17:
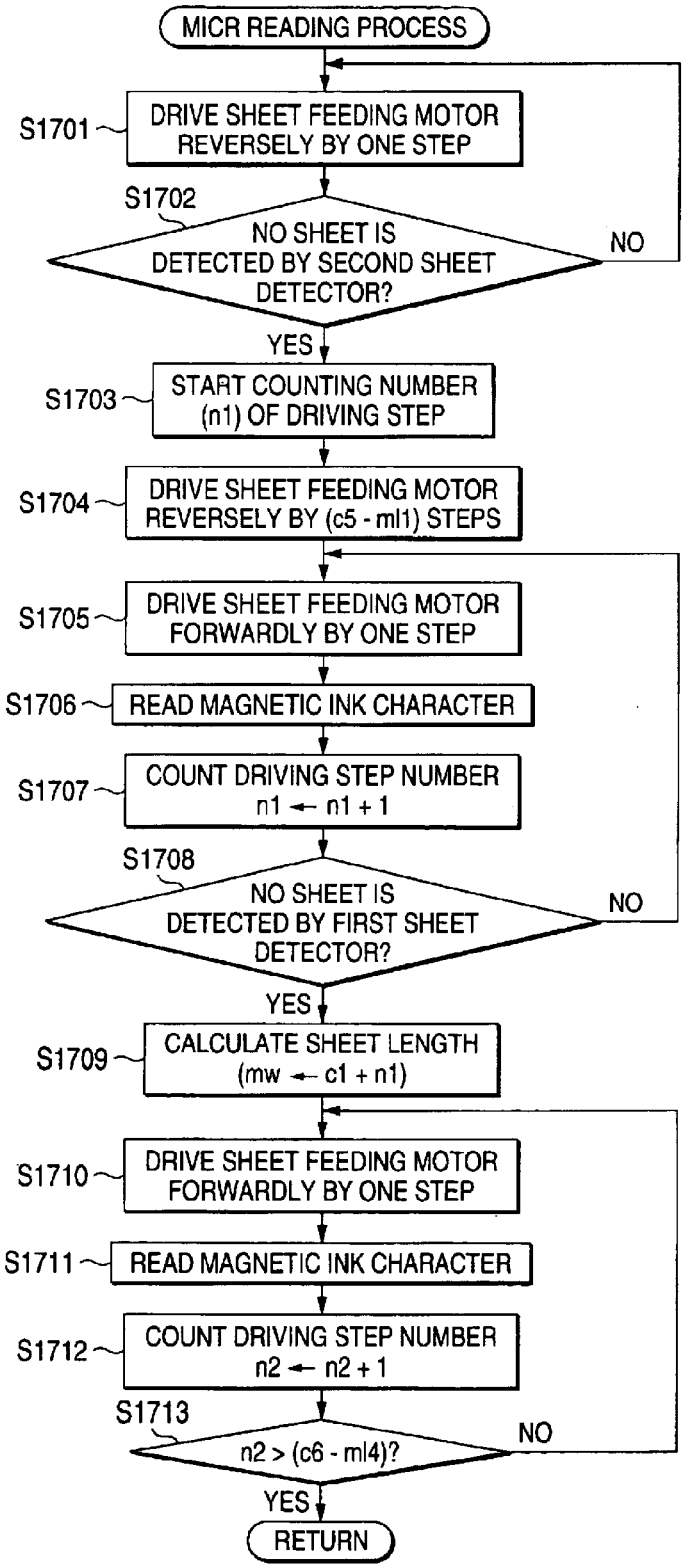
FIG. 17 is a flowchart showing a control procedure of an MICR reading position setting/MICR reading process in the second embodiment.

FIG. 17 is a flowchart showing a control procedure of the MICR reading position setting/MICR reading process in the second embodiment. First, the MICR reading position setting process is performed in order to position the MICR reading starting position M1 of magnetic characters recorded in the magnetic ink character recording area of the check M, onto the magnetic head 34. Specifically, by reversely driving the sheet feeding motor 38 to reversely rotate the driving roller 36, the check M is transported toward the inlet 11 along the first sheet path 30 until the leading end Mt of the check reaches the detecting position of the second sheet detector 39 (S1701, S1702). If it is judged on the basis of the detection signal of the second sheet detector 39 that the leading end Mt of the check M is detected (if no sheet is judged) (S1702; Yes), the counting of the driving step number n1 of the sheet feeding motor 38 is started by the counter N1 provided in the control section 50 (S1703). As a result, with using the detecting position of the second sheet detector 39 as a reference, setting of the positions of the check M can be performed on the basis of the transportation driving step number from the reference position.

Then, the transportation of the check M toward the inlet 11 is continued to position the MICR reading starting position M1 of the check M onto the magnetic head 34 (S1704). At this time, the transportation distance of the check M equals to a difference between the path length C5 of the first sheet path 30 from the detecting position of the second sheet detector 39 to the magnetic head 34, and the length ML1 between the leading end Mt of the check M and the MICR reading starting position M1. Therefore, the distance difference (C5−ML1) is converted into the driving step number of the sheet feeding motor 38, and the sheet feeding motor 38 is reversely driven by the step number (c5−ml1), whereby the check M is transported until the MICR reading starting position M1 is positioned onto the magnetic head 34.

Figure 21B:
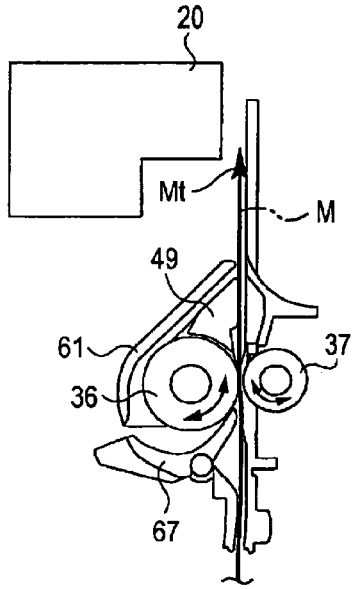

Thereafter, in the same manner as the first embodiment, magnetic ink characters recorded on the check M are read by the magnetic head 34, and the sheet length Mw of the check M is detected while the check M is transported step by step toward the outlet 12 (S1705 to S1709, see FIG. 21B). The process of reading magnetic ink characters is then continued until an MICR reading end position M4 of the check M reaches the magnetic head 34.

In the second embodiment, if it is judged on the basis of the detection signal of the first sheet detector 33 that the trailing end Mb of the check M is detected (if no sheet is judged) (S1708; Yes), the counting of the driving step number n2 of the sheet feeding motor 38 is started by a counter (not shown) provided in the control section 50 (S1712). As a result, with using the detecting position of the first sheet detector 33 as a reference, setting of the positions of the check M can be performed on the basis of the transportation driving step number from the reference position. Then, the process of reading magnetic ink characters is continued until the driving step counted value n2 counted by the counter exceeds a value (c6−ml4) which is obtained by converting a difference (C6−ML4) between the path length C6 of the first sheet path 30 between the detecting position of the first sheet detector 33 and the magnetic head 34, and the length ML4 from the trailing end Mb of the check M to the MICR reading end position M4, into the driving step number of the sheet feeding motor 38 (S1713; No) (S1710, S1711). If the driving step counted value n2 exceeds the step number (c6−ml4) (S1713; Yes), or if the MICR reading end position M4 reaches the magnetic head 34, the MICR reading process is finished.

As described above, in the MICR reading process of the second embodiment, in advance of the reading of magnetic ink characters of the check M, the process of detecting the leading end Mt of the check M (the process of searching the leading end of the check M) is executed, and the process of detecting the sheet length Mw of the check M is then executed in parallel with the reading of magnetic ink characters.

Figure 18:
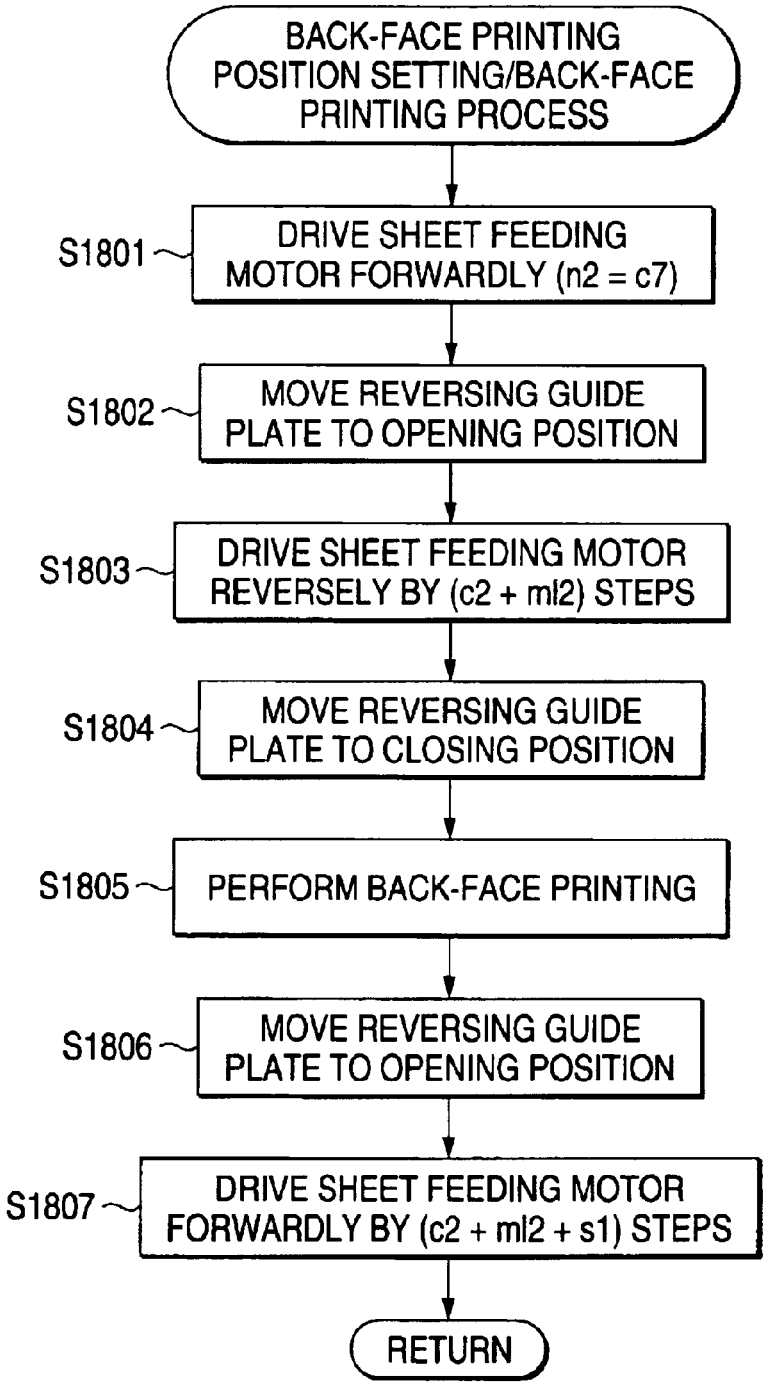
FIG. 18 is a flowchart showing a control procedure of a back-face printing position setting/back-face printing process in the second embodiment.

FIG. 18 is a flowchart showing a control procedure of the back-face printing position setting/back-face printing process in the second embodiment, and FIG. 21 is a diagram showing the operation of the check reversing process in the second embodiment. In order to transport the check M into the second sheet path 40 starting from the trailing end Mb, first, the trailing end Mb of the check M is positioned in the sheet path branching position 47. Specifically, the check M is transported toward the outlet 12 until the driving step counted value n2 of the sheet feeding motor 38 reaches a driving step number c7 of the sheet feeding motor 38 corresponding to the path length C7 from the first sheet detector 33 to the sheet path branching position 47 along the first sheet path 30 (S1801). In the same manner as the first embodiment, thereafter, the back-face printing position setting process (S1803) and the back-face printing process (S1805) are performed, and the check M is returned until the trailing end Mb is positioned in the sheet path branching position 47 (S1807).

Figure 21C:
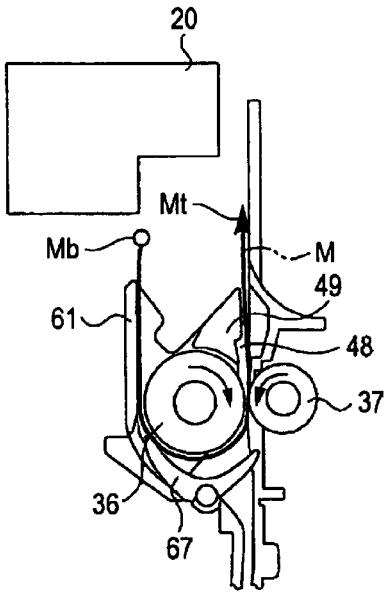
Figure 21D:
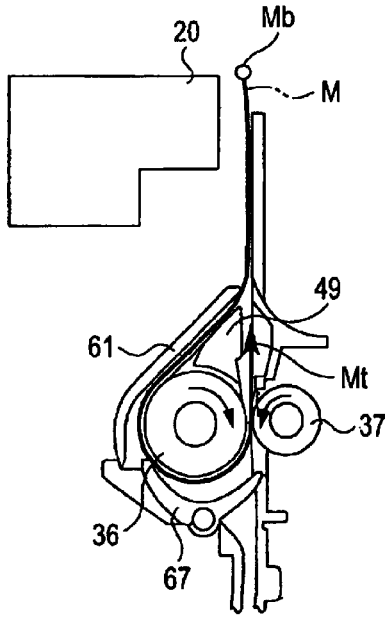

The embodiment is different from the first embodiment in that the reversing guide plate 61 is opened and closed before and after the back-face printing position setting (S1802, S1804, FIG. 21C, FIG. 21D), and that the reversing guide plate 61 is opened before the check M is transported after the back-face printing (S1806). In the case where the check M is to be transported under the state where the reversing guide plate 61 is in the opening position, as shown in FIG. 21C, the check is transported in a substantially J-like shape in a side view while the trailing end Mb is guided by the reversing guide plate 61 which is positioned in the opening position, and the leading end Mt is guided in the first sheet path 30. Therefore, the leading and trailing ends of the check M are prevented from rubbing together, and hence the occurrence of sheet jamming can be reduced. Particularly, it is possible to avoid sheet jamming which may possibly occur in a configuration such as that of the first embodiment that is not provided with a reversing guide open/close mechanism 60, and which is caused in the vicinity of the sheet path joining position 48 when the trailing end Mb of the check M returns from the second sheet path 40 into the first sheet path 30. After the back-face printing, the reversing guide plate 61 is first set to the opening position, and the check M is then transported. In the sheet path joining position 48, therefore, the check M is not bent by the upper end portion of the guide portion 61*a*, and hence the print surface of the check M is not rubbed with the upper end portion of the guide portion 61*a*, with the result that the check M can be transported more smoothly and the print surface can be protected.

The process of step S1804 in which the reversing guide plate 61 is switchingly operated from the opening position to the closing position may be performed before the step number reaches (c2+ml2), under the condition that the trailing end Mb of the check M is transported to a position which exceeds the upper end portion of the guide portion 61*a* in the back-face printing position setting process of S1803.

Figure 19:
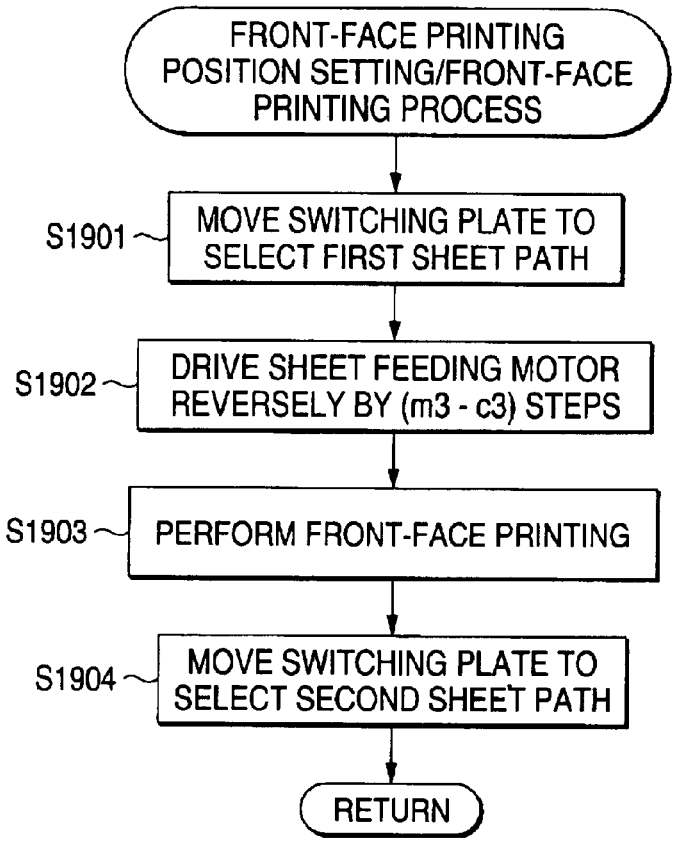
FIG. 19 is a flowchart showing a control procedure of a front-face printing position setting/front-face printing process in the second embodiment.

FIG. 19 is a flowchart showing a control procedure of the front-face printing position setting/front-face printing process in the second embodiment. S1901 to S1904 of the front-face printing process in the second embodiment are substantially identical with S701 to S704 of the front-face printing process in the first embodiment. The embodiment is different from the first embodiment in the switching operation of the switching plate 67. Namely, in order to cause the switching plate 67 to retract from the first sheet path 30 and switchingly operate into the first sheet path selecting posture, the carriage 22 is moved to the position P3 in the left non-printing area (S1901), and, in order to cause the switching plate 67 to protrude into the first sheet path 30 and switchingly operate into the second sheet path selecting posture, the carriage 22 is moved from the position P3 in the left non-printing area (S1904).

Figure 20:
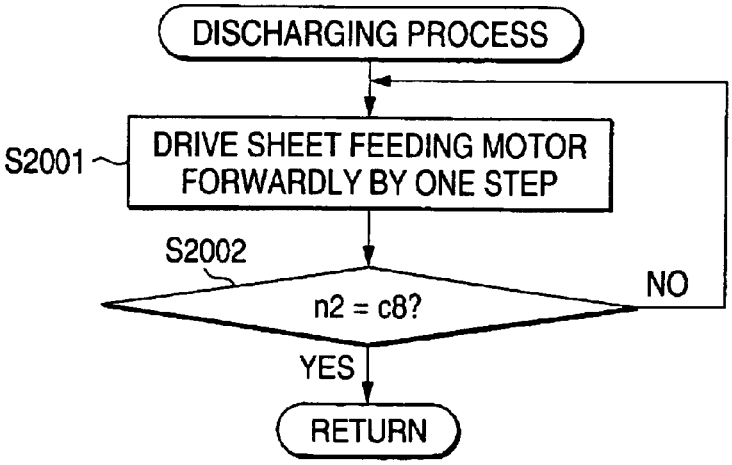
FIG. 20 is a flowchart showing a control procedure of a discharging process in the second embodiment.

FIG. 20 is a flowchart showing a control procedure of the discharging process in the second embodiment. In the same manner as the first embodiment, the check M is transported to a position where the trailing end Mb of the check M is clampingly held by the transporting roller pair 35 (S2001, S2002). The embodiment is different from the first embodiment in that the embodiment is not provided with the sheet path switching detector 46, and hence the sheet feeding motor 38 is forwardly driven until the driving step counted value n2 of the sheet feeding motor 38 reaches a driving step number c8 of the sheet feeding motor 38 corresponding to the path length C8 from the detecting position of the first sheet detector 33 to the transporting roller pair 35.

(Third Embodiment)

Figure 22A:
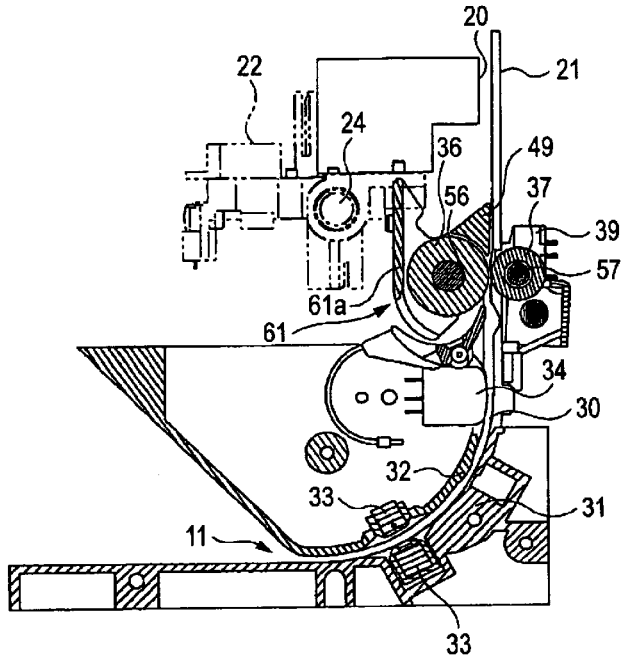
FIG. 22A is a schematic right side sectional view showing the inside of a printer of a third embodiment.
Figure 22B:
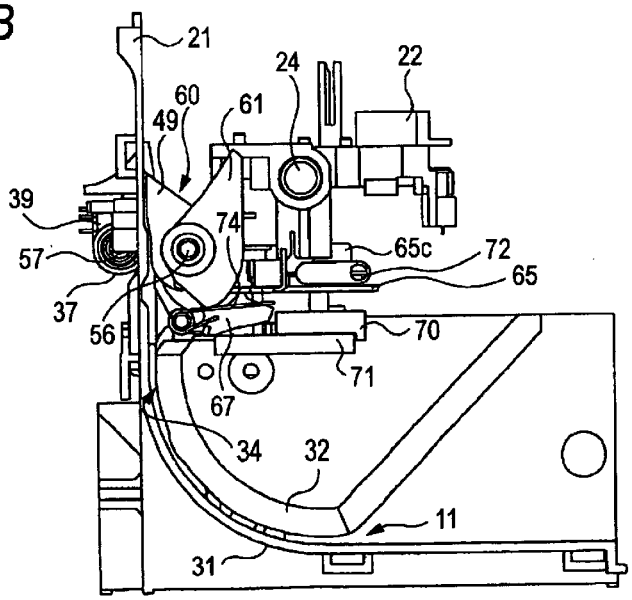
FIG. 22B is a schematic left side sectional view showing the inside of the printer of the third embodiment.

FIG. 22A is a schematic right side sectional view showing the inside of a printer of a third embodiment, and FIG. 22B is a schematic left side sectional view showing the inside of the printer of the third embodiment. As shown in the figures, the third embodiment is different from the second embodiment in the structure of the reversing guide open/close mechanism 60, the operation lever 63 is urged in a clockwise direction by a tension coil spring 72. The embodiment is different also in the structure of the sheet path switching mechanism 42, or in that, in the state of waiting insertion of the check M, the switching plate 67 is urged by a torsion coil spring 74 to retract from the first sheet path 30 and establish the first sheet path selecting posture. Hereinafter, the sheet path switching mechanism 42 will be described.

Figure 23:
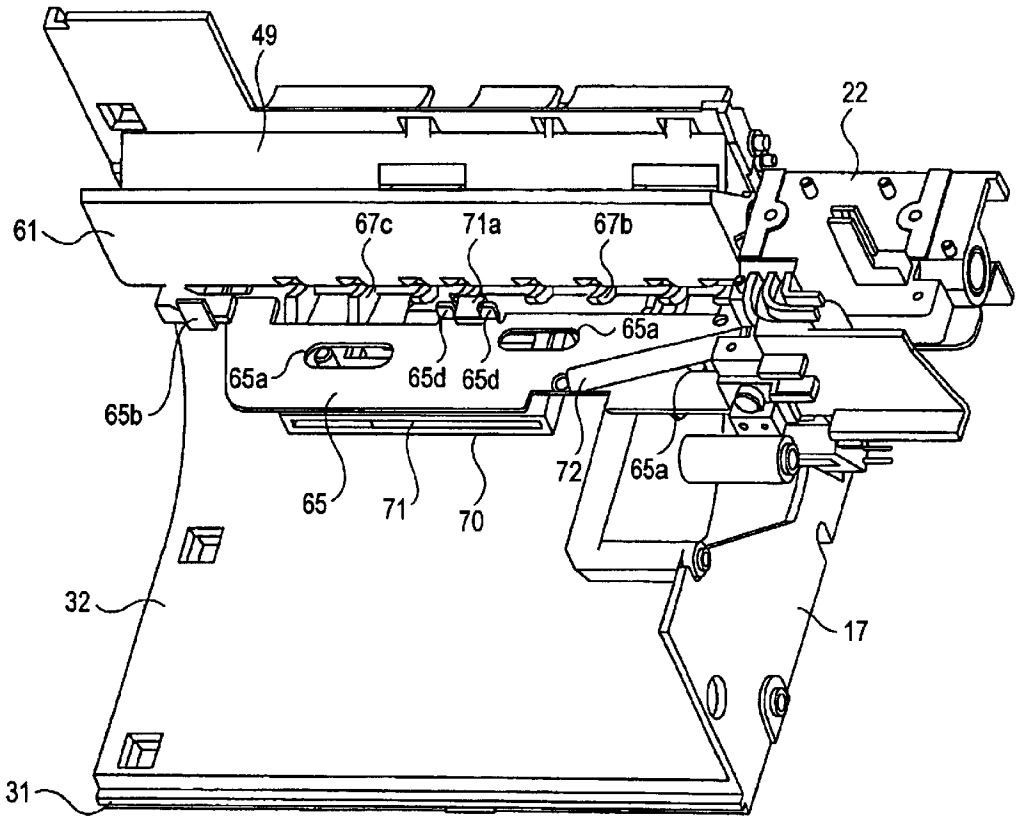
FIG. 23 is a schematic perspective view showing the inside of the printer of the third embodiment.
Figure 24:
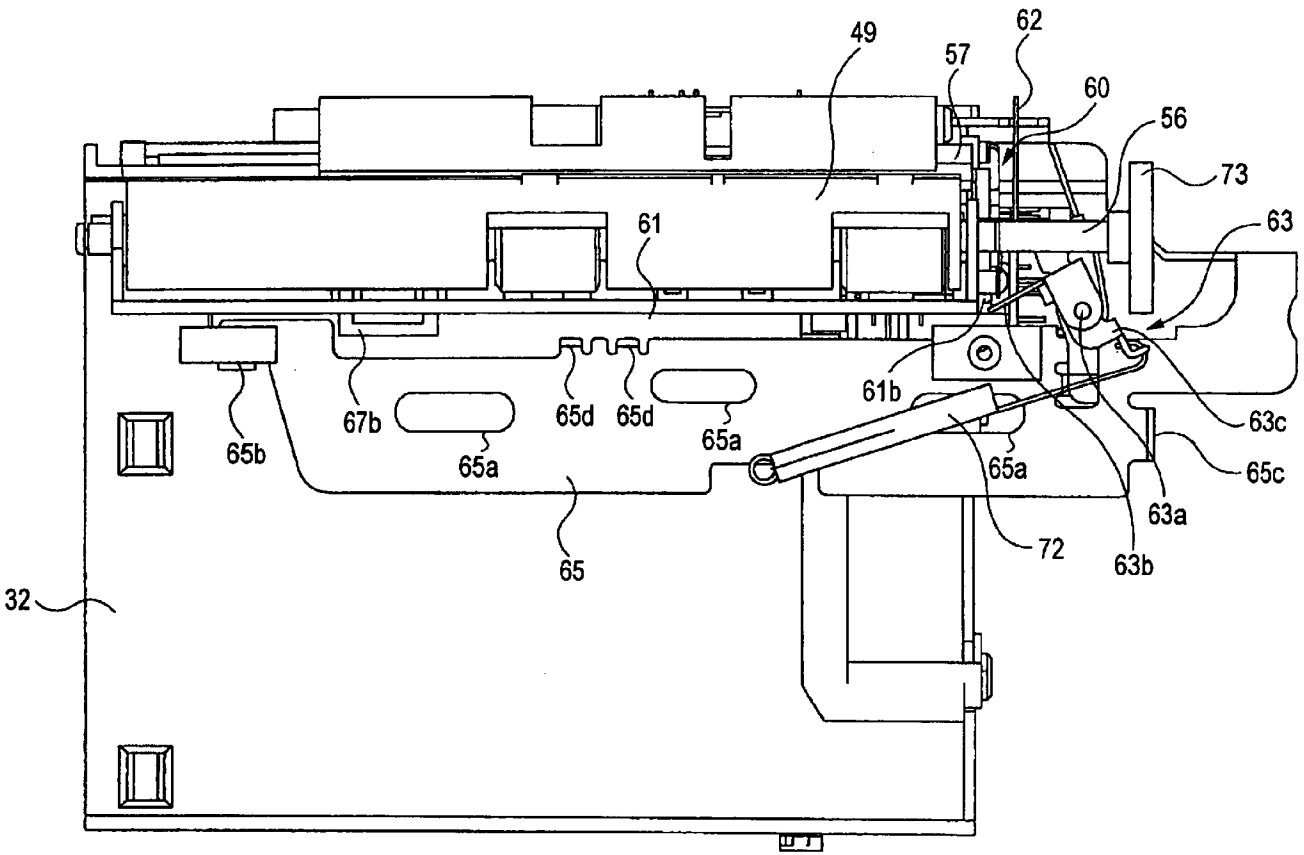
FIG. 24 is a schematic plan view showing the inside of the printer of the third embodiment.
Figure 25A:
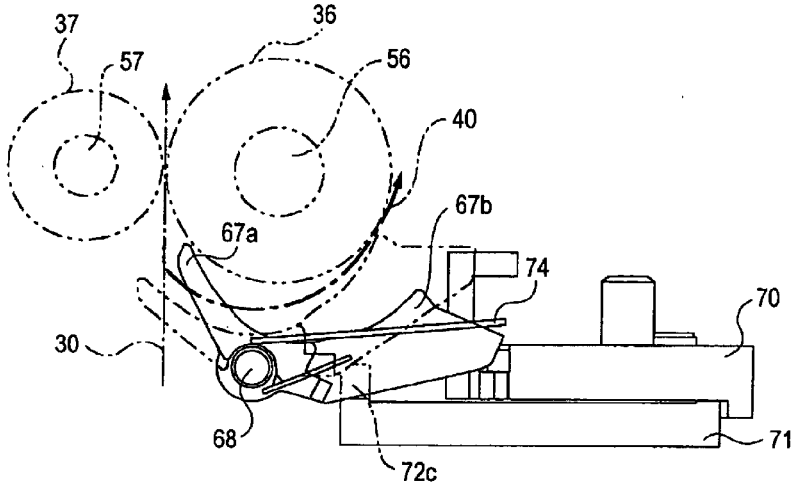
FIG. 25A is a left side view of a sheet path switching mechanism of the printer of the third embodiment.
Figure 25B:
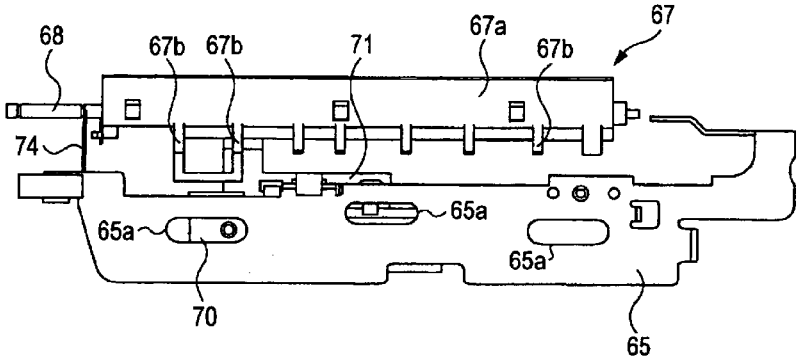
FIG. 25B is a plan view of the sheet path switching mechanism of the printer of the third embodiment.
Figure 25C:
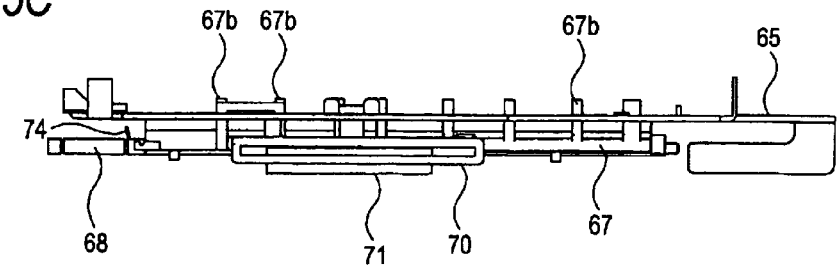
FIG. 25C is a front view of the sheet path switching mechanism of the printer of the third embodiment.

FIG. 23 is a schematic perspective view showing the inside of the printer of the third embodiment, FIG. 24 is a schematic plan view showing the inside of the printer of the third embodiment, FIG. 25A is a left side view of the sheet path switching mechanism of the printer of the third embodiment, FIG. 25B is a plan view of the sheet path switching mechanism of the printer of the third embodiment, and FIG. 25C is a front view of the sheet path switching mechanism of the printer of the third embodiment. As shown in the figures, a slide plate 65 which is laterally slidable is disposed on the carriage frame 17. The slide plate 65 is a plate member which laterally elongates. Slots 65*a* which are laterally elongated are respectively formed in the right and left sides and a center area of the slide plate 65. Guide pins (not shown), which are to be fixed to the carriage frame 17, are inserted through the slots 65*a* in the right and left sides, respectively. The slide plate 65 is supported by the guide pins so as to be laterally slidable. At this time, a predetermined sliding resistance is applied to the slide plate 65, and the slide plate 65 is held to each of cam positions which will be described later, by the sliding resistance. A screw (not shown), which is to be fixed to the carriage frame 17, is inserted through the slot 65*a* in the center area. The slide plate 65 is prevented from slipping off by the screw.

Engagement claws 65*b* and 65*c* are erected in the lateral end sides of the slide plate 65, respectively. The engagement claws 65*b* and 65*c* are engaged with the carriage 22 in the right and left non-printing areas of the carriage movement area, to cause the slide plate 65 to follow the movement of the carriage 22 toward the outer side.

Figure 26A:
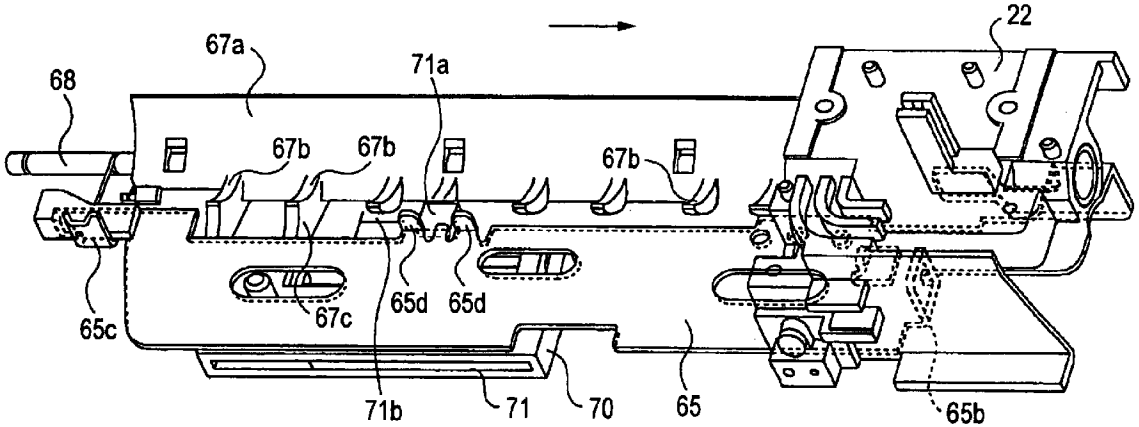
FIG. 26A is a view showing a positional relationship between a carriage and a slide plate.
Figure 26B:
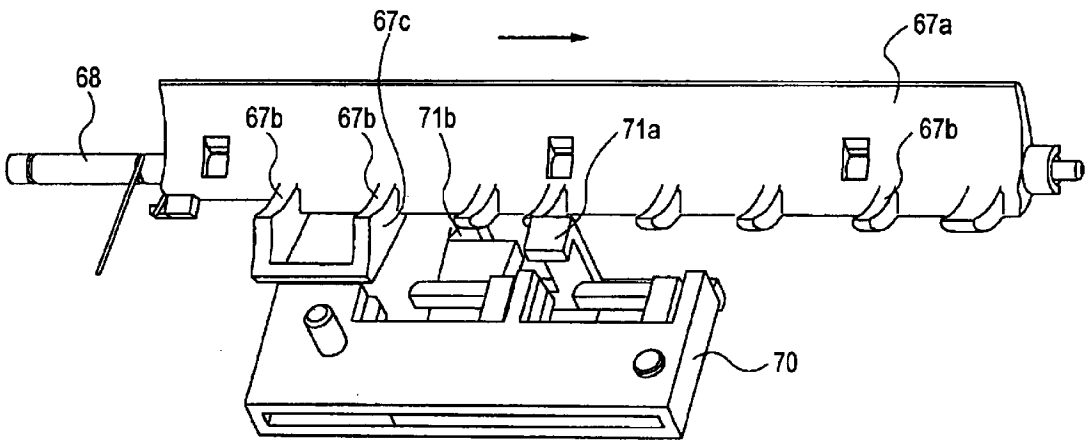
FIG. 26B is a view showing a positional relationship between a switching plate and a switching cam.
Figure 27A:
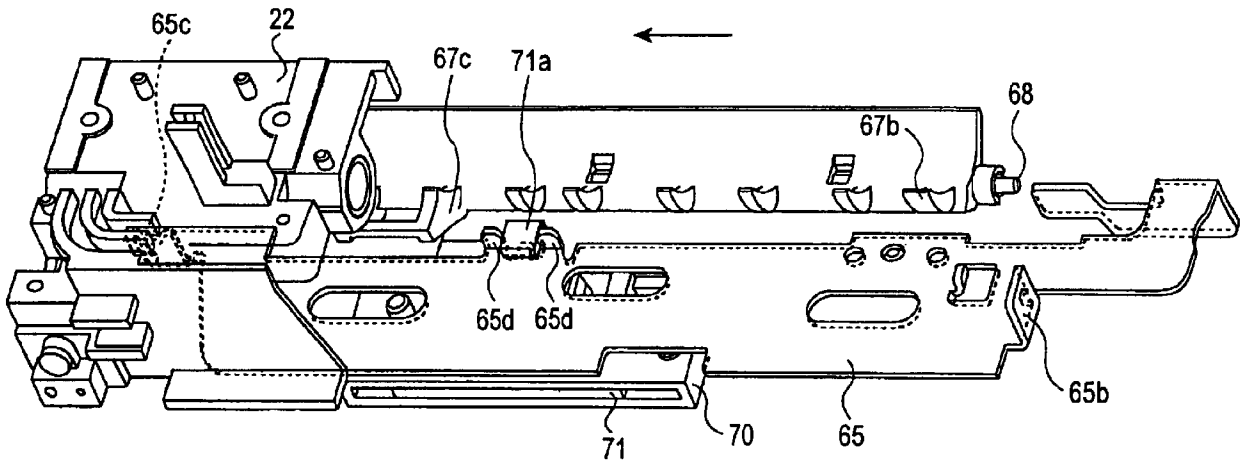
FIG. 27A is a view showing a positional relationship between the carriage and the slide plate.
Figure 27B:
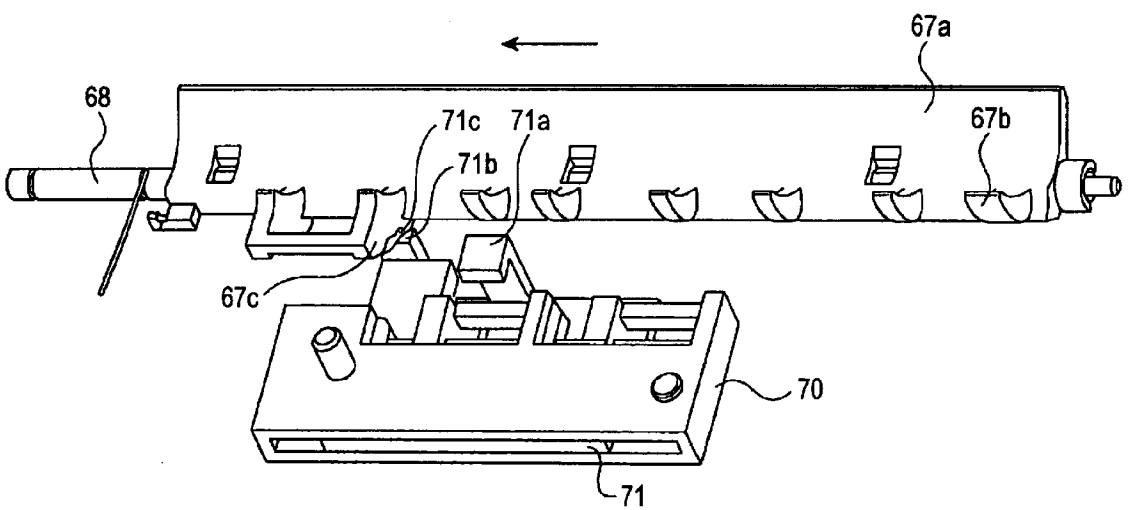
FIG. 27B is a view showing a positional relationship between the switching plate and the switching cam.
Figure 28:
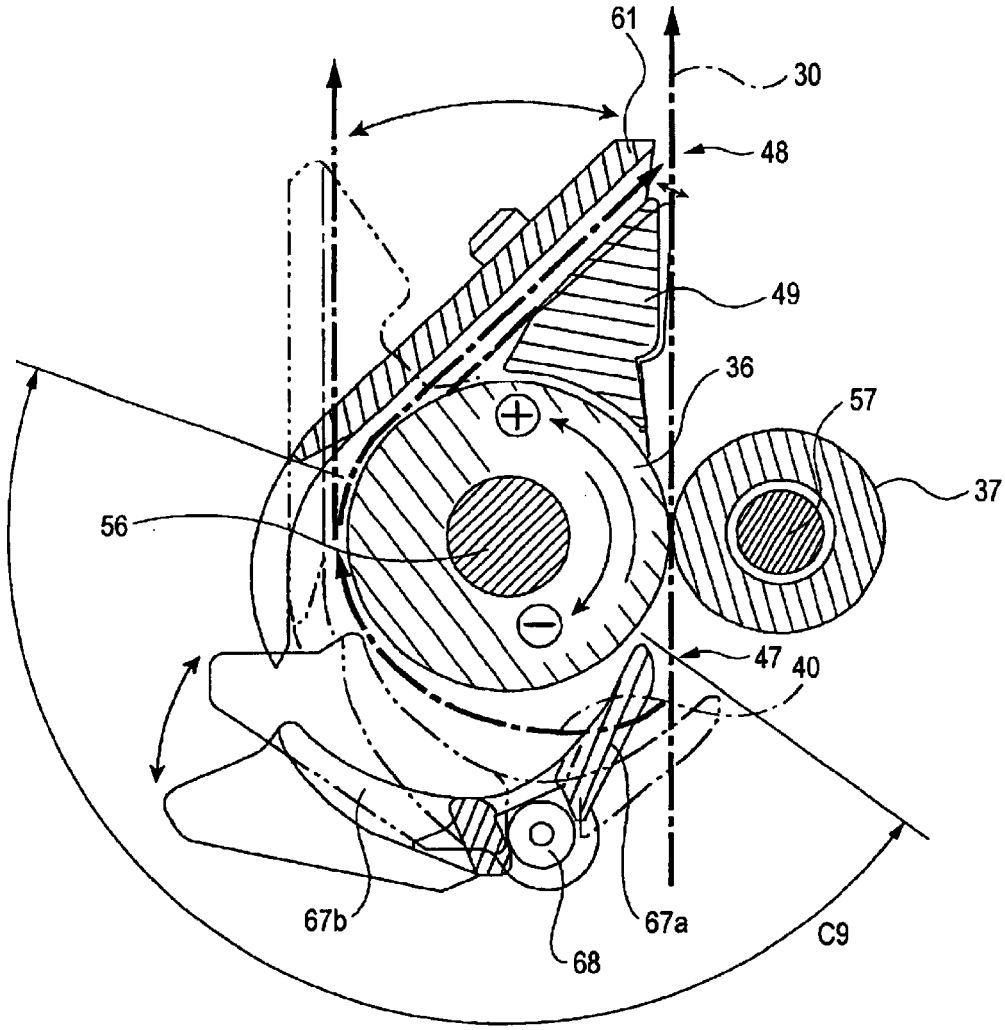
FIG. 28 is a right side sectional view of the switching plate and a reversing guide plate in the third embodiment.

FIG. 26 is a perspective view of the sheet path switching mechanism showing the first sheet path selecting state, FIG. 26A is a view showing a positional relationship between the carriage and the slide plate, FIG. 26B is a view showing a positional relationship between the switching plate and a switching cam, FIG. 27 is a perspective view of the sheet path switching mechanism showing the second sheet path selecting state, FIG. 27A is a view showing a positional relationship between the carriage and the slide plate, FIG. 27B is a view showing a positional relationship between the switching plate and the switching cam, and FIG. 28 is a right side sectional view of the switching plate and the reversing guide plate. As shown in the figures, a switching cam holder 70 which is fixed onto the main frame 15 is placed below the slide plate 65, and a switching cam 71 is supported by the switching cam holder 70 so as to be laterally slidable. An L-like engagement protrusion 71*a* which upwardly extends is formed on a rear end portion of the switching cam 71. The engagement protrusion 71*a* is fitted between engagement claws 65*d* formed on the slide plate 65. According to the configuration, the switching cam 71 follows the movement of the slide plate 65.

A cam piece 71*b* which upwardly extends and rises while being laterally elongated is formed on a left rear end portion of the switching cam 71. A slope portion 71*c* which is slanting at a predetermined angle is formed on a front end portion of the cam piece 71*b*. An engagement portion 67*c* which connects two adjacent ones of the second guide portions 67*b* with each other, and which forward extends is formed on the left front side of the switching plate 67. The engagement portion 67*c* of the switching plate 67 is positioned on the left side with respect to the cam piece 71*b* of the switching cam 71. When the carriage 22 is moved to the position P3 in the left non-printing area, the slide plate 65 is moved to the left cam position, and as shown in FIG. 27 the slope portion 71*c* of the cam piece 71*b* of the switching cam 71 lifts up the engagement portion 67*c* of the switching plate 67, and the engagement portion 67*c* rides on a flat portion 71*d* of the cam piece 71*b*. In this state, in accordance with the upward pivot of the engagement portion 67*c*, the switching plate 67 protrudes into the first sheet path 30 to select the second sheet path 40. By contrast, when the carriage 22 is moved to the position P2 in the right non-printing area, the slide plate 65 is moved to the right cam position, and as shown in FIG. 26 the cam piece 71*b* of the switching cam 71 is not engaged with the engagement portion 67*c* of the switching plate 67. In this state, the switching plate 67 is caused by the urging force of the torsion coil spring 74 to retract from the first sheet path 30 to select the first sheet path 30.

The configuration of the control section 50, and the basic control procedure of the checking process are substantially identical with those of the second embodiment. However, this embodiment is different from the second embodiment in that, in the state of waiting insertion of the check M, the switching plate 67 is urged by the torsion coil spring 74 to establish the first sheet path selecting posture in which the switching plate 67 retracts from the first sheet path 30. The MICR reading process is identical with that of the second embodiment. Therefore, the description of the second embodiment and the drawing (FIG. 17) are applied also to this embodiment, and the description of the process is omitted.

Figure 29:
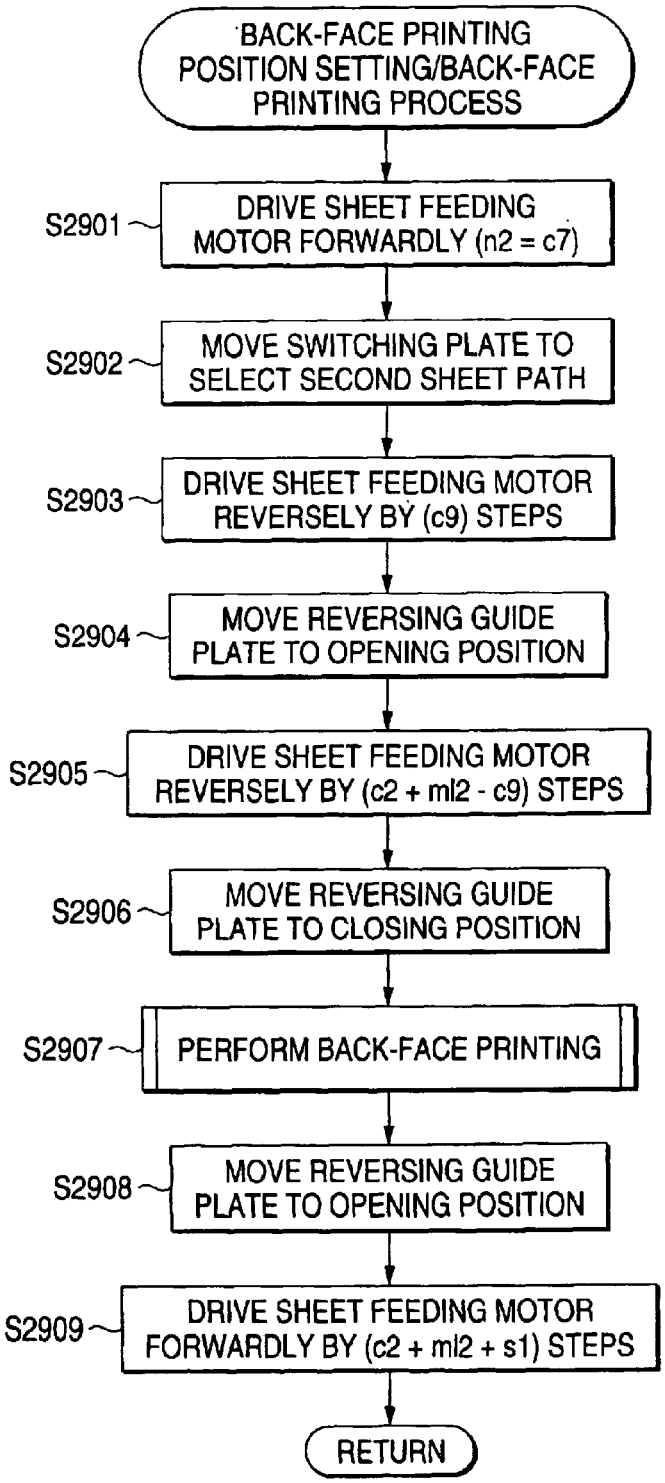
FIG. 29 is a flowchart showing a control procedure of a back-face printing position setting/back-face printing process in the third embodiment.

FIG. 29 is a flowchart showing a control procedure of the back-face printing position setting/back-face printing process in the third embodiment. In order to transport the check M into the second sheet path 40, first, the trailing end Mb of the check M is positioned in the sheet path branching position 47 in the same manner as step S1801 (S2901). Thereafter, the carriage 22 is moved to the position P3 in the left non-printing area, and the switching plate 67 is switchingly operated into the second sheet path selecting posture in which the switching plate 67 protrudes into the first sheet path 30 (S2902). In accordance with the movement of the carriage 22, the reversing guide plate 61 is moved to the closing position. The sheet feeding motor 38 is reversely driven to reversely rotate the driving roller 36, whereby the check M is sent into the second sheet path 40 and then transported until the trailing end Mb passes over the tip end portions of the second guide portions 67*b* of the switching plate 67 to be positioned at the lower end portion of the guide portion 61*a* of the reversing guide plate 61. At this time, the transportation distance of the check M equals to the path length C9 of the second sheet path 40 from the sheet path branching position 47 to the lower end portion of the guide portion 61*a*. Therefore, the path length C9 is converted into the driving step number of the sheet feeding motor 38, and the sheet feeding motor 38 is reversely driven by the step number c9, whereby the check M is transported until the trailing end Mb is positioned at the lower end portion of the guide portion 61*a* of the reversing guide plate 61 (S2903).

Then, the transportation of the check M is temporarily stopped, and the carriage 22 is moved to the position P2 in the right non-printing area to move the reversing guide plate 61 to the opening position (S2904). Alternatively, the reversing guide plate may be switchingly operated while the transportation is continued. At this time, in accordance with the movement of the carriage 22, the switching plate 67 is switchingly operated into the first sheet path selecting posture in which the switching plate 67 retracts from the first sheet path 30. After the reversing guide plate 61 is moved to the opening position, the sheet feeding motor 38 is again reversely driven to transport the check M until the transportation distance of the check M from the sheet path branching position 47 reaches (C2+ML2), to perform the back-face printing position setting (S2905). The check M is transported along the reversing guide plate 61 which is in the opening position, and in substantially parallel with the first sheet path 30. Then, the carriage 22 is moved leftward from the right non-printing area P2 to close the reversing guide plate 61, thereby forming the second sheet path 40 (S2906). In accordance with the movement of the reversing guide plate 61, the side of the trailing end Mb of the check M is guided by the guide portion 61*a* to be moved into the first sheet path 30, and the back-face printing starting position M2 is placed on the print head 20. In the same manner as the second embodiment, thereafter, the print head 20 is driven to perform the back-face printing while reversely driving the sheet feeding motor 38 to transport the check M (S2907). After the back-face printing is finished, the carriage 22 is moved to the right non-printing area P2 to move the reversing guide plate 61 to the opening position (S2908), and the check M is returned until the trailing end Mb is positioned in the sheet path branching position 47 (S2909).

Figure 30:
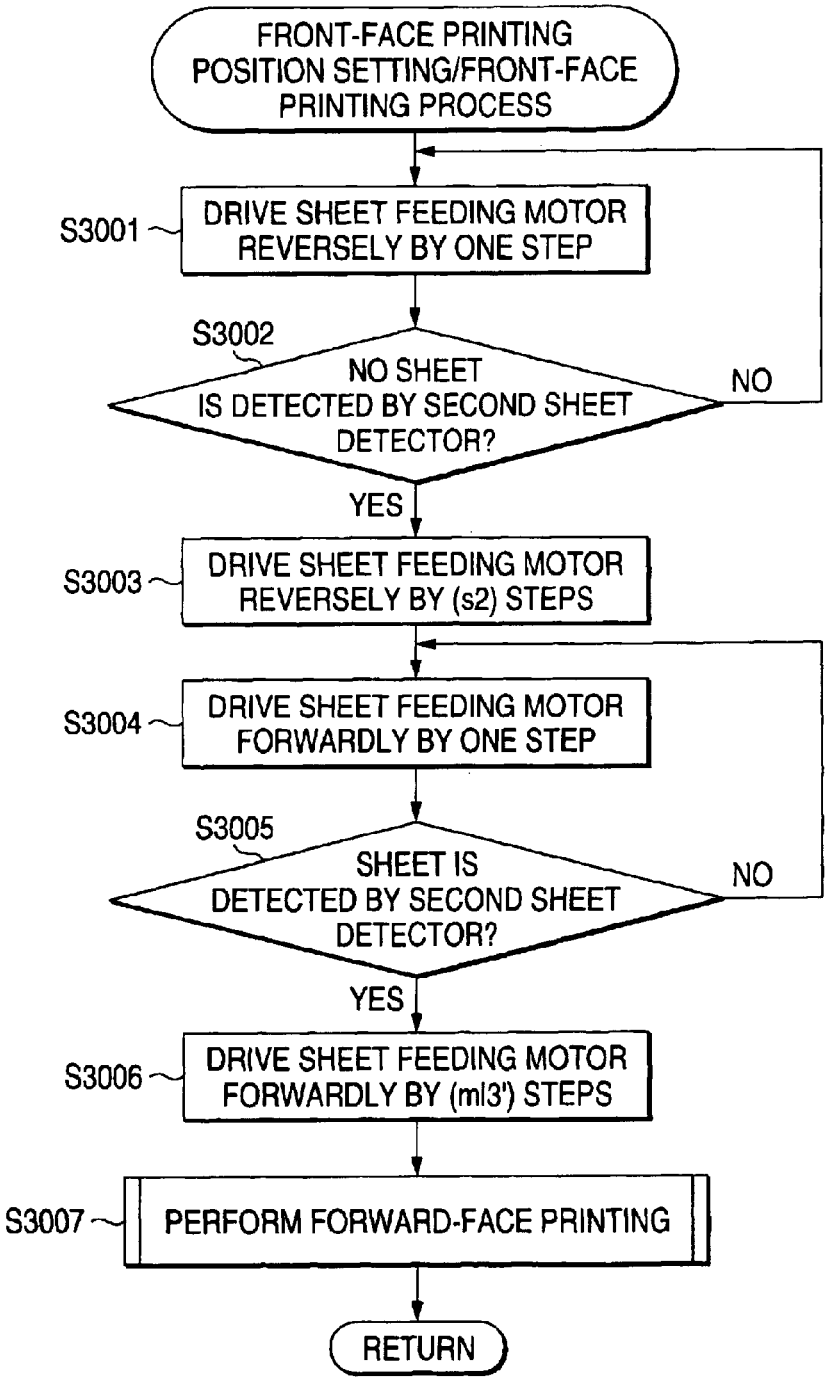
FIG. 30 is a flowchart showing a control procedure of a front-face printing position setting/front-face printing process in the third embodiment.

FIG. 30 is a flowchart showing a control procedure of the front-face printing position setting/front-face printing process in the third embodiment. First, the leading end Mt of the check M is detected on the basis of the detection signal of the second sheet detector 39. Specifically, the sheet feeding motor 38 is reversely driven, and the check M is transported step by step until the leading end Mt reaches the detecting position of the second sheet detector 39 (S3001, S3002). Furthermore, the sheet feeding motor 38 is reversely driven by a predetermined step number s2 (arbitrary) to transport the check M until the leading end Mt is positioned in a side which is upstream by a certain degree from the detecting position of the second sheet detector 39 (S3003). Next, the sheet feeding motor 38 is forwardly driven, and the check M is transported step by step until the leading end Mt reaches the detecting position of the second sheet detector 39 (S3004, S3005). As a result, it is possible to eliminate backlash of the sheet driving system. Then, the distance ML3' between the leading end Mt of the check M and the front-face printing starting position M3 is converted into the driving step number of the sheet feeding motor 38, and the sheet feeding motor 38 is forwardly driven by the step number ml3', whereby the check M is transported until the front-face printing starting position M3 is opposed to the print head 20 (S3006). After the front-face printing position setting is finished, the print head 20 is driven to perform the front-face printing while the check M is transported with directing the leading end Mt to the outlet 12 (S3007).

The discharging process is identical with that of the second embodiment. Therefore, the description of the second embodiment and the drawing (FIG. 20) are applied also to the embodiment, and the description of the process is omitted.

As described above, according to the first embodiment of the invention, the second sheet path 40 serving as a sheet path for reversing the check M is formed into an arcuate shape along the outer periphery of the driving roller 36. Therefore, the check M can be reversed in a J-like shape while the check is clampingly held by the transporting roller pair 35, and hence double-sided printing which is performed on the check M by the common print head 20 is enabled. As compared with the configuration in which a recording sheet is reversed while being transferred among plural rollers, the occurrence of sheet jamming can be suppressed. Moreover, the length of the second sheet path 40 serving as a reversing path can be reduced, so that the printer can be downsized and the processing time can be shortened. Since the print head 20 and the driving roller 36 are positioned on the same side with respect to the first sheet path 30, moreover, printing can be performed on the back face of the check M even in the case where the length of the check M in the transportation direction is so long that, during the back-face printing, the portions on the side of the trailing end Mb and that of the leading end Mt overlap with each other in the position of the print head 20.

According to the second embodiment of the invention, the reversing guide plate 61, which forms the second sheet path 40, is configured so as to be pivotable. Therefore, it is possible to prevent sheet jamming from occurring when the end portion of the check M in the advancing direction, i.e., the trailing end Mb enters the first sheet path 30 from the second sheet path 40. When the check M is returned into the first sheet path 30, the check M is not bent at the sheet path joining position 48. Therefore, the check M can be more smoothly transported, and the print surface (rear print surface) of the check M can be protected.

According to the third embodiment of the invention, the switching plate 67 is urged by the torsion coil spring 74 to the first sheet path selecting posture in which the switching plate 67 selects the first sheet path 30, and is supported by the switching cam 71 to the second sheet path selecting posture in which the switching plate 67 selects the second sheet path 40. When the check M is reversed, therefore, the switching plate 67 is not pivoted by the stiffness of the recording sheet. Consequently, the length of the second sheet path 40 can be maintained constant, and hence, the back-face printing position setting/back-face printing process can be accurately performed.

As described above, according to the invention, it is possible to provide a printer comprising a reversing mechanism in which a sheet is reversed in a J-like shape while the sheet is clampingly held by a single transporting roller pair, to enable double-sided printing to be performed on the sheet irrespective of the length of the sheet, and prevention of a transport failure, reduction of the number of parts, and down-sizing of the printer are realized. Particularly, the invention is preferably applied to a printer for particular application such as a check in which printing is not performed on the whole back face of the sheet but performed on a restricted area of the back face of the sheet.

Although the embodiment of the invention has been described with reference to the drawings, the invention is not restricted to the description of the embodiment, and includes a range in which one skilled in the art can perform modification and application on the basis of the description of the claims and the best mode for carrying out the invention, and well-known techniques.

What is claimed is:

1. A printer, comprising:

a first sheet path;

a print head, disposed with respect to the first sheet path to perform printing on a recording sheet;

a transporting roller pair including a first roller and a second roller, adapted to transport the recording sheet in a first direction toward the print head and a second direction opposed to the first direction;

a second sheet path, branched from the first sheet path at a branching position spaced from the transporting roller pair in the second direction, the second sheet oath extending along an outer periphery of the first roller, and joined to the first sheet path at a joining position between the transporting roller pair and the print head; and a path switcher, disposed in the vicinity of the branching position so as to be placed at a first position for selecting the first sheet path and a second position for selecting the second sheet path, so that a path of the recording sheet transported in the second direction is selectively switched between the first sheet path and the second sheet path.

2. The printer as set forth in claim 1, further comprising:

an urging member, which urges the path switcher toward one of the first position and the second position; and a retainer, which retains the path switcher at the other one of the first position and the second position.

3. The printer as set forth in claim 2, further comprising an actuator, which places the path switcher to the other one of the first position and the second position.

4. The printer as set forth in claim 2, further comprising:

a carriage, on which the print head is mounted, adapted to reciprocally move in directions substantially perpendicular to the first direction and the second direction; and a switching cam, which places the path switcher to the other one of the first position and the second position, in accordance with a movement of the carriage to a predetermined position.

5. The printer as set forth in claim 2, further comprising:

a carriage, on which the print head is mounted, adapted to reciprocally move in directions substantially perpendicular to the first direction and the second direction; and a switching cam, selectively placed at one of a plurality of cam positions while following a movement of the carriage toward non-printing areas, so as to place the path switcher to the first position when the carriage is placed at a first switching position arranged in one of the non-printing areas, and so as to place the path switcher to the second position when the carriage is placed at a second switching position arranged in the other one of the non-printing areas.

6. The printer as set forth in claim 5, wherein the switching cam includes a cam piece adapted to be abutted against an engaging portion of the path switcher to displace the path switcher.

7. The printer as set forth in claim 1, further comprising a switching controller, which places the path switcher to one of the first position and the second position when a trailing end of the recording sheet transported along the first sheet path in the first direction situates a position shifted from the branching position in the first direction, and drives the transporting roller pair to transport the recording sheet in the second direction.

8. The printer as set forth in claim 1, further comprising a guide member, which forms at least a part of the second sheet path, the guide member being placed at an opening position for guiding the recording sheet in directions substantially parallel to the first sheet path and a closing position for guiding the recording sheet to the joining position.

9. The printer as set forth in claim 8, further comprising an urging member, which urges the guide member toward one of the opening position and the closing position.

10. The printer as set forth in 8, further comprising:

a carriage, on which the print head is mounted, adapted to reciprocally move in directions substantially perpendicular to the first direction and the second direction; and a pivotable guide operator, provided with a first engagement member adapted to be engaged with the carriage and a second engagement member adapted to be engaged with the guide member, wherein the guide operator is pivoted by engaging the first engagement member with the carriage when the carriage is moved to a predetermined position, so that the second engagement member engages with the guide member to displace the guide member against an urging force of the urging member.

11. The printer as set forth in claims 8, further comprising a guide controller, which places the guide member to the closing position after a leading end of the recording sheet transported in the second direction along the guide member placed at the opening position passes an end portion of the guide member which is closer to the joining position.

12. The printer as set forth in claim 11, wherein the guide controller places the guide member to the opening position in a case where a leading end of the recording sheet is transported in the first direction when the trailing end of the recording sheet situates a position closer to the print head than the joining position.

13. The printer as set forth in claim 8, further comprising a positioning stopper, displaceable between a position projecting into the first sheet path and a position retracted from the first sheet path, the positioning stopper forming the second sheet path together with the guide member placed at the closing position.

14. The printer as set forth in claim 1, further comprising a print controller, which controls the printer to perform printing on a first face of the recording sheet transported along the first sheet path, and to perform printing on a second face of the recording sheet transported by way of the second sheet path.

15. The printer as set forth in claim 1, wherein the print head and the first roller are arranged on the same side with respect to the first sheet path.

16. A mechanism for reversing a sheet for duplex printing, the mechanism comprising:

a primary sheet path;

a transporting roller pair including rollers disposed on opposite sides of the primary sheet path, the transporting roller pair transporting the sheet along the primary sheet path in a first direction and in a second direction opposed to the first direction;

a print head disposed adjacent the primary sheet path and spaced from the transporting roller pair in the first direction;

a secondary sheet path branched from the primary sheet path at a branching point disposed on a side of the transporting roller pair opposite from the print head; and a path switcher selectively disposed in the primary sheet path for selectively guiding the sheet from the primary sheet path to the secondary sheet path, wherein the secondary sheet path is positioned relative to the primary sheet path to reverse the sheet in the primary sheet path with reversing a direction of the transporting roller pair a single time.

17. The mechanism according to claim 16, wherein the secondary sheet path is joined to the first sheet path at a joining position between the transporting roller pair and the print head.

18. A printer comprising:

a primary sheet path;

a transporting roller pair including rollers disposed on opposite sides of the primary sheet path, the transporting roller pair transporting the sheet along the primary sheet path in a first direction and in a second direction opposed to the first direction;

a print head disposed adjacent the primary sheet path and spaced from the transporting roller pair in the first direction to perform printing on a recording sheet;

a secondary sheet path branched from the primary sheet path at a branching point disposed on a side of the transporting roller pair opposite from the print head; and a path switcher selectively disposed in the primary sheet path for selectively guiding the recording sheet from the primary sheet path to the secondary sheet path, wherein the transporting roller pair comprises the only rollers for reversing the recording sheet for duplex printing.

* * * * *